US006412577B1

(12) United States Patent
Chen

(10) Patent No.: US 6,412,577 B1
(45) Date of Patent: Jul. 2, 2002

(54) ROLLER-CONE BITS, SYSTEMS, DRILLING METHODS, AND DESIGN METHODS WITH OPTIMIZATION OF TOOTH ORIENTATION

(75) Inventor: Shilin Chen, Dallas, TX (US)

(73) Assignee: Halliburton Energy Services Inc., Carrollton, TX (US)

( * ) Notice: Subject to any disclaimer, the term of this patent is extended or adjusted under 35 U.S.C. 154(b) by 0 days.

(21) Appl. No.: 09/629,344

(22) Filed: Aug. 1, 2000

Related U.S. Application Data

(63) Continuation of application No. 09/387,304, filed on Aug. 31, 1999, now Pat. No. 6,095,262.
(60) Provisional application No. 60/098,442, filed on Aug. 31, 1998.

(51) Int. Cl.[7] ..... E21B 10/16
(52) U.S. Cl. ..... 175/57; 76/108.2; 175/374
(58) Field of Search ..... 175/57, 374, 376, 175/378, 331; 76/108.2, 108.4

(56) References Cited

U.S. PATENT DOCUMENTS 4,187,922 A * 2/1980 Phelps ..... 175/374
4,393,948 A * 7/1983 Fernandez ..... 175/374
4,427,081 A * 1/1984 Crawford ..... 175/376
4,815,342 A * 3/1989 Brett et al. ..... 76/108.2
5,197,555 A * 3/1993 Estes ..... 175/431
5,224,560 A * 7/1993 Fernandez ..... 175/374
5,372,210 A * 12/1994 Harrell ..... 175/431
5,415,030 A * 5/1995 Jogi et al. ..... 73/152.03
5,704,436 A * 1/1998 Smith et al. ..... 175/27
5,730,234 A * 3/1998 Putot ..... 175/30
5,767,399 A * 6/1998 Smith et al. ..... 73/152.11
5,794,720 A * 8/1998 Smith et al. ..... 175/40
6,095,262 A * 8/2000 Chen ..... 175/57
6,213,225 B1 * 4/2001 Chen ..... 175/57

FOREIGN PATENT DOCUMENTS

GB 2241266A * 8/1991

* cited by examiner

*Primary Examiner*—Hoang Dang
(74) *Attorney, Agent, or Firm*—Robert Groover

(57) ABSTRACT

A novel and improved roller cone drill bit and method of design are disclosed. A roller cone drill bit for drilling through subterranean formations having an upper connection for attachment to a drill string, and a plurality cutting structures rotatably mounted on arms extending downward from the connection. A number of teeth are located in generally concentric rows on each cutting structure. The actual trajectory by which the teeth engage the formation is mathematically determined. A straight-line trajectory is calculated based on the actual trajectory. The teeth are positioned in the cutting structures such each tooth having a designed engagement surface is oriented perpendicular to the calculated straight-line trajectory.

6 Claims, 21 Drawing Sheets

ERA22_V Cone No.2

ERA22_V Cone No.3

ROLLER-CONE BITS, SYSTEMS, DRILLING METHODS, AND DESIGN METHODS WITH OPTIMIZATION OF TOOTH ORIENTATION

CROSS REFERENCE TO RELATED APPLICATIONS

This application is a continuation of application Ser. No. 09/387,304 filed Aug. 11, 1999 (now issued as U.S. Pat. No. 6,095,262), and therethrough claims priority from provisional application Ser. No. 60/098,442 filed Aug. 31, 1998.

BACKGROUND AND SUMMARY OF THE INVENTION

The present invention relates generally to the drilling of oil and gas wells, or similar drilling operations, and in particular to orientation of tooth angles on a roller cone drill bit.

BACKGROUND: ROTARY DRILLING

Oil wells and gas wells are drilled by a process of rotary drilling, using a drill rig such as is shown in FIG. 10. In conventional vertical drilling, a drill bit 10 is mounted on the end of a drill string 12 (drill pipe plus drill collars), which may be more than a mile long, while at the surface a rotary drive (not shown) turns the drill string, including the bit at the bottom of the hole.

Two main types of drill bits are in use, one being the roller cone bit, an example of which is seen in FIG. 11. In this bit a set of cones 16 (two are visible) having teeth or cutting inserts 18 are arranged on rugged bearings on the arms of the bit. As the drill string is rotated, the cones will roll on the bottom of the hole, and the teeth or cutting inserts will crush the formation beneath them. (The broken fragments of rock are swept uphole by the flow of drilling fluid.) The second type of drill bit is a drag bit, having no moving parts, seen in FIG. 12.

Drag bits are becoming increasingly popular for drilling soft and medium formations, but roller cone bits are still very popular, especially for drilling medium and medium-hard rock. There are various types of roller cone bits: insert-type bits, which are normally used for drilling harder formations, will have teeth of tungsten carbide or some other hard material mounted on their cones. As the drill string rotates, and the cones roll along the bottom of the hole, the individual hard teeth will induce compressive failure in the formation.

The bit's teeth must crush or cut rock, with the necessary forces supplied by the "weight on bit" (WOB) which presses the bit down into the rock, and by the torque applied at the rotary drive. While the WOB may in some cases be 100,000 pounds or more, the forces actually seen at the drill bit are not constant: the rock being cut many have harder and softer portions (and may break unevenly), and the drill string itself can oscillate in many different modes. Thus the drill bit must be able to operate for long periods under high stresses in a remote environment.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours and is a significant expense in the drilling budget. To resume drilling the entire process must be reversed. Thus the bit's durability is very important, to minimize round trips for bit replacement during drilling.

BACKGROUND: DRILL STRING OSCILLATION

The individual elements of a drill string appear heavy and rigid. However, in the complete drill string (which can be more than a mile long), the individual elements are quite flexible enough to allow oscillation at frequencies near the rotary speed. In fact, many different modes of oscillation are possible. (A simple demonstration of modes of oscillation can be done by twirling a piece of rope or chain: the rope can be twirled in a flat slow circle, or, at faster speeds, so that it appears to cross itself one or more times.) The drill string is actually a much more complex system than a hanging rope, and can oscillate in many different ways; see *WAVE PROPAGATION IN PETROLEUM ENGINEERING*, Wilson C. Chin, (1994).

The oscillations are damped somewhat by the drilling mud, or by friction where the drill pipe rubs against the walls, or by the energy absorbed in fracturing the formation: but often these sources of damping are not enough to prevent oscillation. Since these oscillations occur down in the wellbore, they can be hard to detect, but they are generally undesirable. Drill string oscillations change the instantaneous force on the bit, and that means that the bit will not operate as designed. For example, the bit may drill oversize, or off-center, or may wear out much sooner than expected. Oscillations are hard to predict, since different mechanical forces can combine to produce "coupled modes"; the problems of gyration and whirl are an example of this.

BACKGROUND: ROLLER CONE BIT DESIGN

The "cones" in a roller cone bit need not be perfectly conical (nor perfectly frustroconical), but often have a slightly swollen axial profile. Moreover, the axes of the cones do not have to intersect the centerline of the borehole. (The angular difference is referred to as the "offset" angle.) Another variable is the angle by which the centerline of the bearings intersects the horizontal plane of the bottom of the hole, and this angle is known as the journal angle. Thus as the drill bit is rotated, the cones typically do not roll true, and a certain amount of gouging and scraping takes place. The gouging and scraping action is complex in nature, and varies in magnitude and direction depending on a number of variables.

Conventional roller cone bits can be divided into two broad categories: Insert bits and steel-tooth bits. Steel tooth bits are utilized most frequently in softer formation drilling, whereas insert bits are utilized most frequently in medium and hard formation drilling.

Steel-tooth bits have steel teeth formed integral to the cone. (A hardmetal is typically applied to the surface of the teeth to improve the wear resistance of the structure.) Insert bits have very hard inserts (e.g. specially selected grades of tungsten carbide) pressed into holes drilled into the cone surfaces. The inserts extend outwardly beyond the surface of the cones to form the "teeth" that comprise the cutting structures of the drill bit.

The design of the component elements in a rock bit are interrelated (together with the size limitations imposed by the overall diameter of the bit), and some of the design parameters are driven by the intended use of the product. For example, cone angle and offset can be modified to increase or decrease the amount of bottom hole scraping. Many other design parameters are limited in that an increase in one parameter may necessarily result in a decrease of another. For example, increases in tooth length may cause interference with the adjacent cones.

BACKGROUND; TOOTH DESIGN

The teeth of steel tooth bits are predominantly of the inverted "V" shape. The included angle (i.e. the sharpness of the tip) and the length of the tooth will vary with the design of the bit. In bits designed for harder formations the teeth will be shorter and the included angle will be greater. Gage row teeth (i.e. the teeth in the outermost row of the cone, next to the outer diameter of the borehole) may have a "T" shaped crest for additional wear resistance.

The most common shapes of inserts are spherical, conical, and chisel. Spherical inserts have a very small protrusion and are used for drilling the hardest formations. Conical inserts have a greater protrusion and a natural resistance to breakage, and are often used for drilling medium hard formations.

Chisel shaped inserts have opposing flats and a broad elongated crest, resembling the teeth of a steel tooth bit. Chisel shaped inserts are used for drilling soft to medium formations. The elongated crest of the chisel insert is normally oriented in alignment with the axis of cone rotation. Thus, unlike spherical and conical inserts, the chisel insert may be directionally oriented about its center axis. (This is true of any tooth which is not axially symmetric.) The axial angle of orientation is measured from the plane intersecting the center of the cone and the center of the tooth.

BACKGROUND: ROCK MECHANICS AND FORMATIONS

There are many factors that determine the drillability of a formation. These include, for example, compressive strength, hardness and/or abrasivity, elasticity, mineral content (stickiness), permeability, porosity, fluid content and interstitial pressure, and state of under-ground stress.

Soft formations were originally drilled with "fish-tail" drag bits, which sheared the formation away. Roller cone bits designed for drilling soft formations are designed to maximize the gouging and scraping action. To accomplish this, cones are offset to induce the largest allowable deviation from rolling on their true centers. Journal angles are small and cone-profile angles will have relatively large variations. Teeth are long, sharp, and widely-spaced to allow for the greatest possible penetration. Drilling in soft formations is characterized by low weight and high rotary speeds.

Hard formations are drilled by applying high weights on the drill bits and crushing the formation in compressive failure. The rock will fail when the applied load exceeds the strength of the rock. Roller cone bits designed for drilling hard formations are designed to roll as close as possible to a true roll, with little gouging or scraping action. Offset will be zero and journal angles will be higher. Teeth are short and closely spaced to prevent breakage under the high loads. Drilling in hard formations is characterized by high weight and low rotary speeds.

Medium formations are drilled by combining the features of soft and hard formation bits. The rock breaks away (is failed) by combining compressive forces with limited shearing and gouging action that is achieved by designing drill bits with a moderate amount of offset. Tooth length is designed for medium extensions as well. Drilling in medium formations is most often done with weights and rotary speeds between that of the hard and soft formations. Area drilling practices are evaluated to determine the optimum combinations.

BACKGROUND: ROLLER CONE BIT INTERACTION WITH THE FORMATION

In addition to improving drilling efficiency, the study of bottom hole patterns has allowed engineers to prevent detrimental phenomena such as those known as tracking, and gyration. The impressions a tooth makes into the formation depend largely on the design of the tooth, the tangential and radial scraping motions of the tooth, the force and speed with which the tooth impacts the formation, and the characteristics of the formation. Tracking occurs when the teeth of a drill bit fall into the impressions in the formation formed by other teeth at a preceding moment in time during the revolution of the drill bit. Gyration occurs when a drill bit fails to drill on-center. Both phenomena result in slow rates of penetration, detrimental wear of the cutting structures and premature failure of bits. Other detrimental conditions include excessive uncut rings in the bottom hole pattern. This condition can cause gyration, result in slow rates of penetration, detrimental wear of the cutting structures and premature failure of the bits. Another detrimental phenomenon is bit lateral vibration, which can be caused by radial force imbalances, bit mass imbalance, and bit/formation interaction among other things. This condition includes directional reversals and gyration about the hole center often known as whirl. Lateral vibration results in poor bit performance, overgage hole drilling, out-of-round, or "lobed" wellbores, and premature failure of both the cutting structures and bearing systems of bits. (Kenner and Isbell, *DYNAMIC ANALYSIS REVEALS STABILITY OF ROLLER CONE ROCK BITS, SPE*28314, 1994).

BACKGROUND: BIT DESIGN

Currently, roller cone bit designs remain the result of generations of modifications made to original designs. The modifications are based on years of experience in evaluating bit records, dull bit conditions, and bottom hole patterns.

One method commonly used to discourage bit tracking is known as a staggered tooth design. In this design the teeth are located at unequal intervals along the circumference of the cone. This is intended to interrupt the recurrent pattern of impressions on the bottom of the hole. Examples of this are shown in U.S. Pat. No. 4,187,922 and UK application 2,241,266.

BACKGROUND: SHORTCOMINGS OF EXISTING BIT DESIGNS

The economics of drilling a well are strongly reliant on rate of penetration. Since the design of the cutting structure of a drill bit controls the bit's ability to achieve a high rate of penetration, cutting structure design plays a significant role in the overall economics of drilling a well. Current bit designs have not solved the issue of tracking. Complex mathematical models can simulate bottom hole patterns to a limited extent, but they do not suggest a solution to the ever-present problem of tracking. The known angular orientations of teeth designed to improve tooth impact strength leave excessive uncut bottom hole patterns and do not solve the problem of tracking. The known angular orientations of teeth designed to increase bottom hole coverage, fail to optimize tooth orientation and do not solve the problem of tracking. Staggered tooth designs do not prevent tracking of the outermost rows of teeth. On the outermost rows of each cone, the teeth are encountering impressions in the formation left by teeth on other cones. The staggered teeth are just as likely to track an impression as any other tooth. Another disadvantage to staggered designs is that they may cause fluctuations in cone rotational speed, resulting in fluctuations in tooth impact force and increased bit vibration. Bit vibration is very harmful to the life of the bit and the life of the entire drill string.

BACKGROUND: CUTTING STRUCTURE DESIGN

In the publication *A NEW WAY TO CHARACTERIZE THE GOUGING-SCRAPING ACTION OF ROLLER CONE BITS* (Ma, Society of Petroleum Engineers No. 19448, 1989), the author determines that a tooth in the first (heel or gage) row of the drill bit evaluated contacts the formation at −22 degrees (measured with respect to rotation of the cone about its journal) and begins to separate at an angle of −6 degrees. The author determines that the contacting range for the second row of the same cone is from −26 degrees to 6 degrees. The author states that "because the crest of the chisel inserts are always in the parallel direction with the generatrix of the roller cone . . . radial scraping will affect the sweep area only slightly." The author concludes that scraping distance is a more important than the velocity of the cutter in determining performance.

In U.S. Pat. No. 5,197,555, Estes discloses a roller cone bit having opposite angular axial orientation of chisel shaped inserts in the first and second rows of a cone. This invention is premised on the determination that inserts scrape diagonally inboard and either to the leading side (facing in the direction of rotation) or to the trailing side (facing opposite to the direction of rotation). It is noted that the heel row inserts engage the formation to the leading side, while the second row inserts engage the formation to the trailing edge. In one embodiment, the inserts in the heel row are axially oriented at an angle between 30 degrees and 60 degrees, while the inserts in the second row are axially oriented between 300 degrees and 330 degrees. This orientation is designed to provide the inserts with a higher resistance to breakage. In an alternative embodiment, the inserts in the heel row are oriented at an axial angle between 300 degrees and 330 degrees, while the inserts in the second row are axially oriented between 30 degrees and 60 degrees. This orientation is designed to provide the inserts with a broader contact area with the formation for increased formation removal, and thereby an increased rate of penetration of the drill bit into the formation.

SUMMARY: ROLLER-ONE BITS, SYSTEMS, DRILLING METHODS, AND DESIGN METHODS WITH OPTIMIZATION OF TOOTH ORIENTATION

The present application describes bit design methods (and corresponding bits, drilling methods, and systems) in which tooth orientation is optimized jointly with other parameters, using software which graphically displays the linearized trajectory of each tooth row, as translated onto the surface of the cone. Preferably the speed ratio of each cone is precisely calculated, as is the curved trajectory of each tooth through the formation. However, for quick feedback to a design engineer, linear approximations to the tooth trajectory are preferably displayed.

The disclosed innovations, in various embodiments, provide one or more of at least the following advantages:

- The disclosed methods provide a very convenient way for designers to take full advantage of the precision of a computer-implemented calculation of geometries. (The motion over hole bottom of roller cone bit teeth is so complex that only a complex mathematical model and associated computer program can provide accurate design support.)
- The disclosed methods provide convenient calculation of tooth trajectory over the hole bottom during the period when the tooth engages into and disengages from the formation.
- The disclosed methods permit the orientation angle of teeth in all rows to be accurately determined based on the tooth trajectory.
- The disclosed methods permit the influence of tooth orientation changes on bit coverage ratio over the hole bottom to be accurately estimated and compensated.
- The disclosed methods also permit designers to optimally select different types of teeth for different rows, based on the tooth trajectory.

The following patent application describes roller cone drill bit design methods and optimizations which can be used separately from or in synergistic combination with the methods disclosed in the present application. That application, which has common ownership, inventorship, and effective filing date with the present application. is: application Ser. No. 09/387,737, filed Aug. 31, 1999, now U.S. Pat. No. 6,213,225 entitled "Force-Balanced Roller-Cone Bits, Systems, Drilling Methods, and Design Methods" (atty. docket No. SC-9825), claiming priority from U.S. provisional application Ser. No. 60/098,466 filed Aug. 31, 1998.

That nonprovisional application, and its provisional priority application, are both hereby incorporated by reference.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Overview of Sample Design Process

Figure 1A:
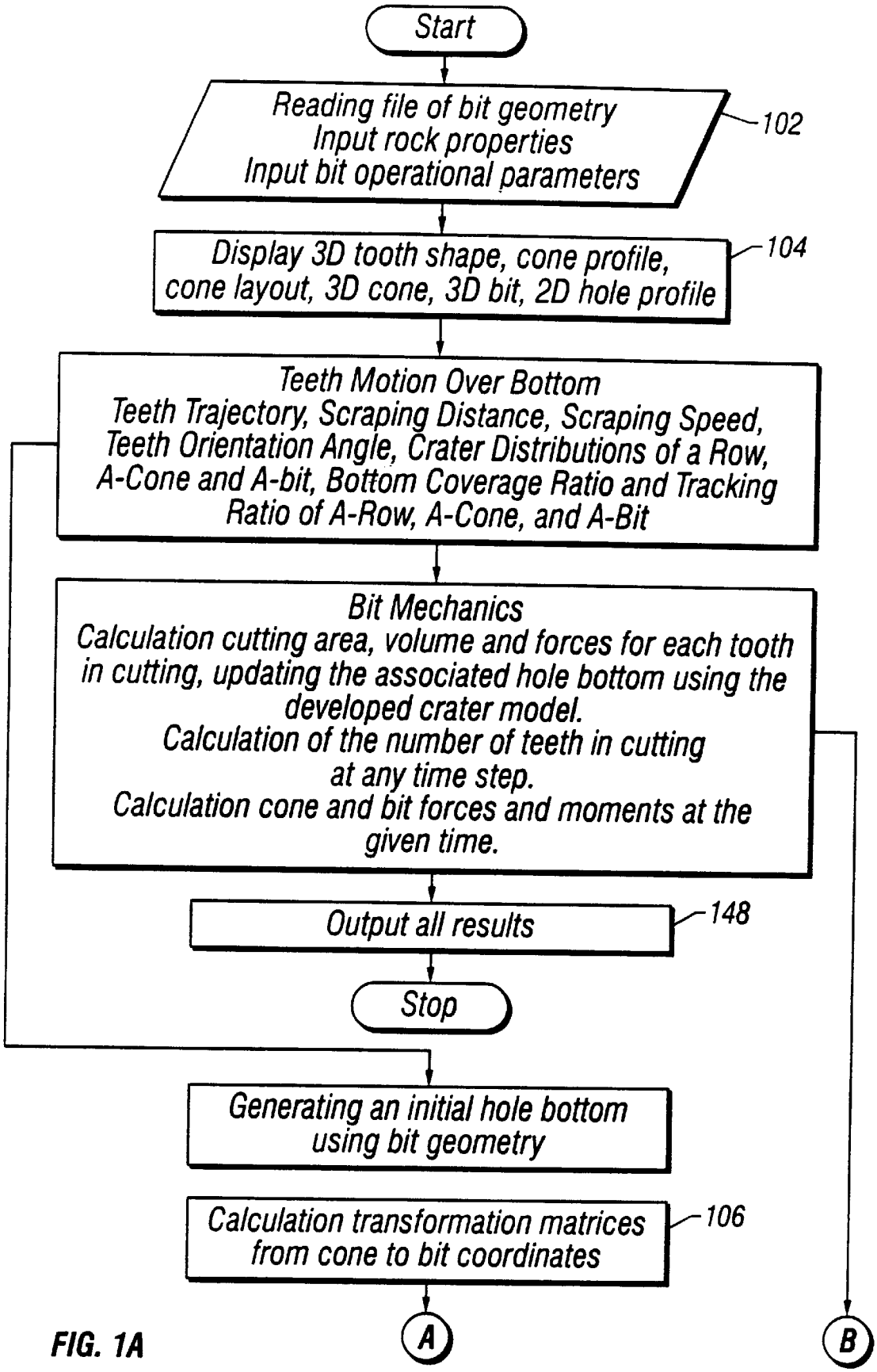
FIGS. 1A–1C shows a sample embodiment of a bit design process, using the teachings of the present application.
Figure 1B:
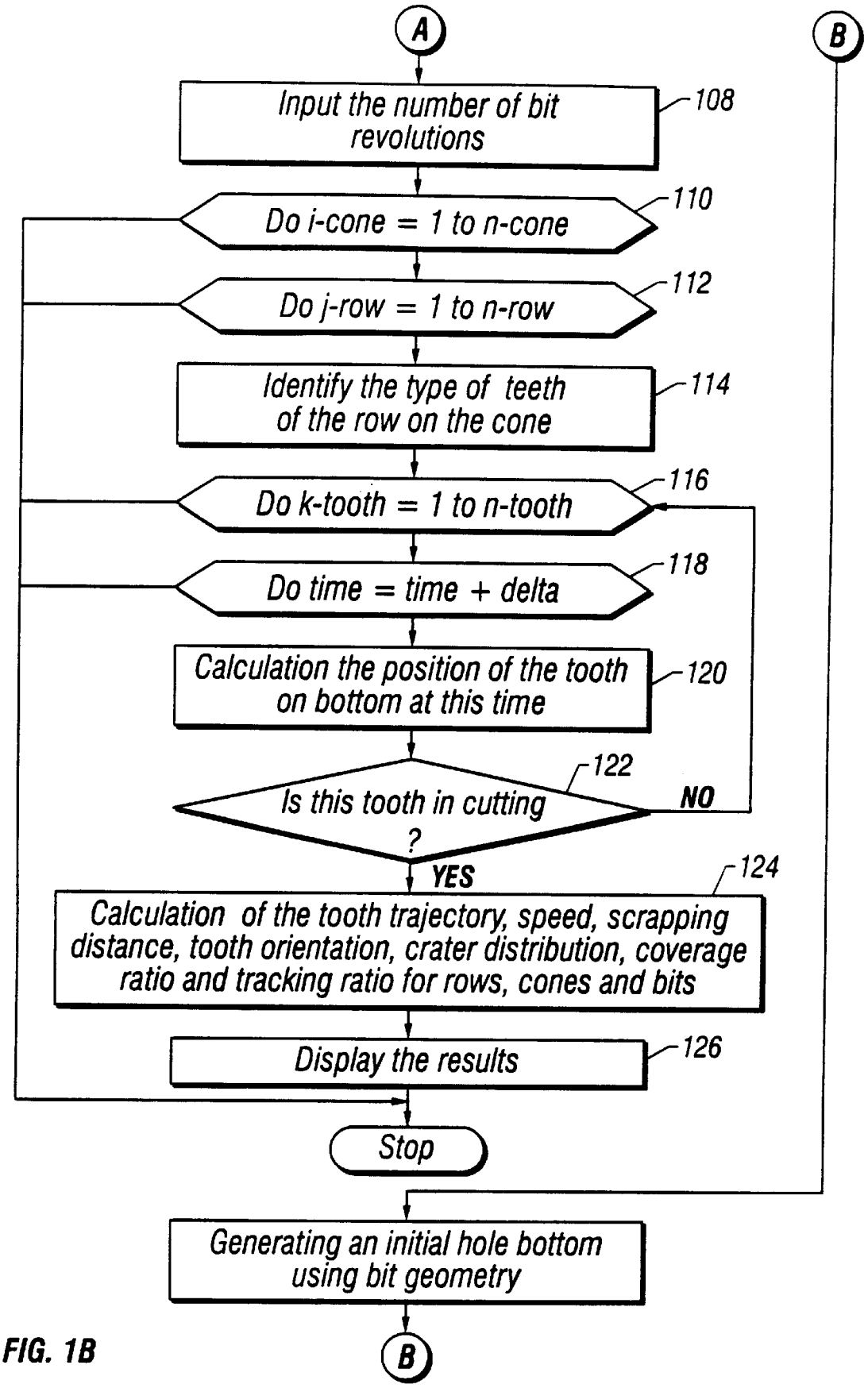
Figure 1C:
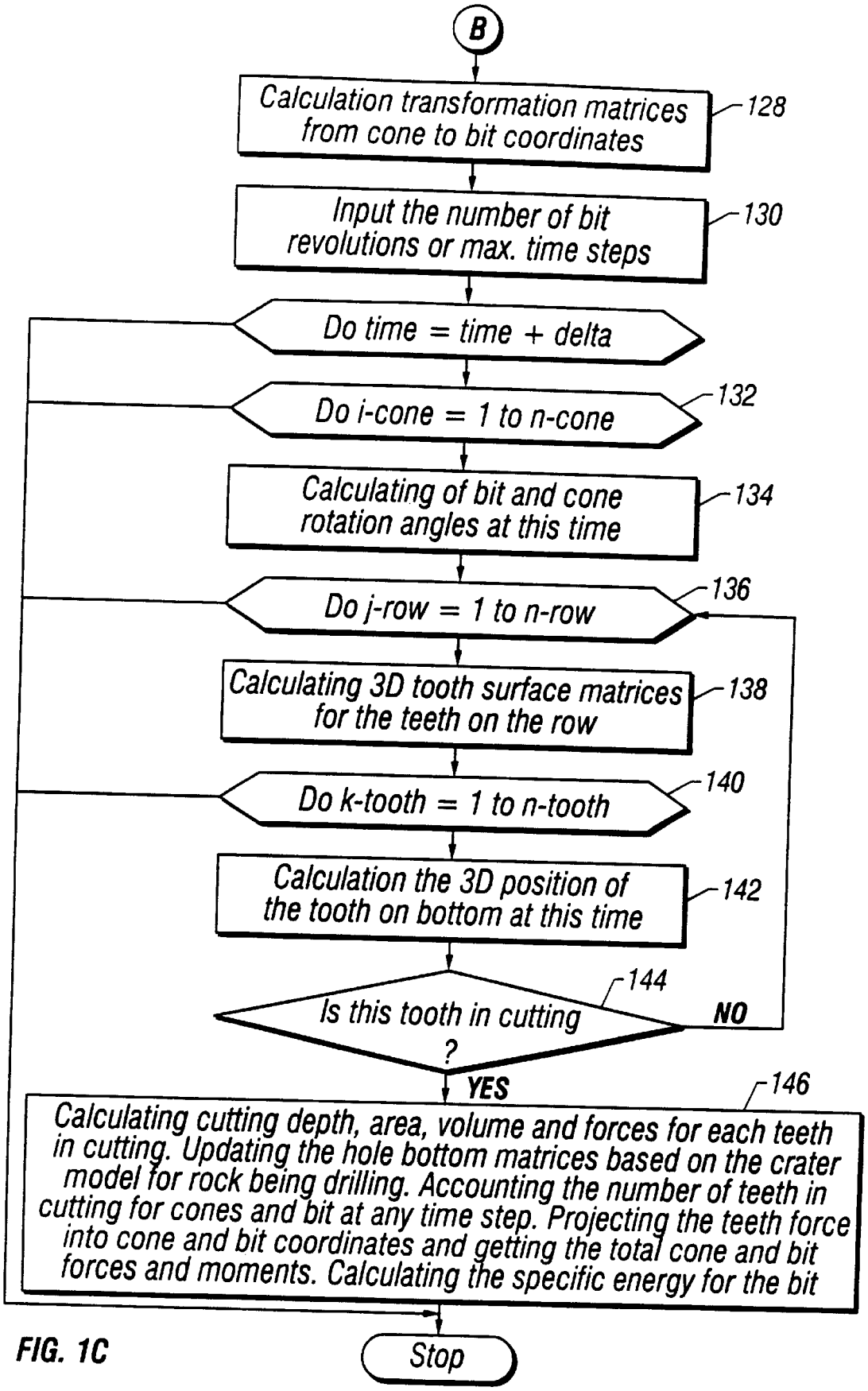

FIGS. 1A–1C show a sample embodiment of a bit design process, using the teachings of the present application. Specifically, FIG. 1A shows an overview of the design process, and FIGS. 1B and 1C expand specific parts of the process.

First, the bit geometry, rock properties, and bit operational parameters are input (step 102). Then the 3D tooth shape, cone profile, cone layout, 3D cone, 3D bit, and 2D hole profile are displayed (step 104).

Since there are two types of rotation relevant to the calculation of the hole bottom (cone rotation and bit rotation), transformation matrices from cone to bit coordinates must be calculated (step 106). (See FIG. 1B.) The number of bit revolutions is input (step 108), and each cone is counted (step 110), followed by each row of teeth for each cone (step 112). Next, the type of teeth of each row is identified (step 114), and the teeth are counted (step 116). Next, a time interval delta is set (step 118), and the position of each tooth is calculated at this time interval (step 120). If a given tooth is not "cutting" (i.e., in contact with the hole bottom), then the algorithm continues counting until a cutting tooth is reached (step 122). The tooth trajectory, speed, scraping distance, crater distribution, coverage ratio and tracking ratios for all rows, cones, and the bit are calculated (step 124). This section of the process (depicted in FIG. 1B) gives the teeth motion over the hole bottom, and displays the results (step 126).

Next the bit mechanics are calculated. (See FIG. 1C.) Again transformation matrices from cone to bit coordinates are calculated (step 128), and the number of bit revolutions and maximum time steps, delta, are input (step 130). The cones are then counted (step 132), the bit and cone rotation angles are calculated at the given time step (step 134), and the rows are counted (step 136). Next, the 3D tooth surface matrices for the teeth on a given row are calculated (step 138). The teeth are then counted (step 140), and the 3D position of the tooth on the hole bottom is calculated at the given time interval (step 142). If a tooth is not cutting, counting continues until a cutting tooth is reached (step 144). The cutting depth, area, volume and forces for each tooth are calculated, and the hole bottom model is updated (based on the crater model for the type of rock being drilled). Next the number of teeth cutting at any given time step is counted. The tooth force is projected into cone and bit coordinates, yielding the total cone and bit forces and moments. Finally the specific energy of the bit is calculated (step 146).

Finally, all results are outputted (step 148). The process can then be reiterated if needed.

Four Coordinate Systems

Four coordinate systems are used, in the presently preferred embodiment, to define the crest point of a tooth in three dimensional space. All the coordinate system obey the "Right Hand Rule". These coordinate systems—tooth, cone, bit, and hole—are described below.

Local Tooth Coordinates

Figure 13:
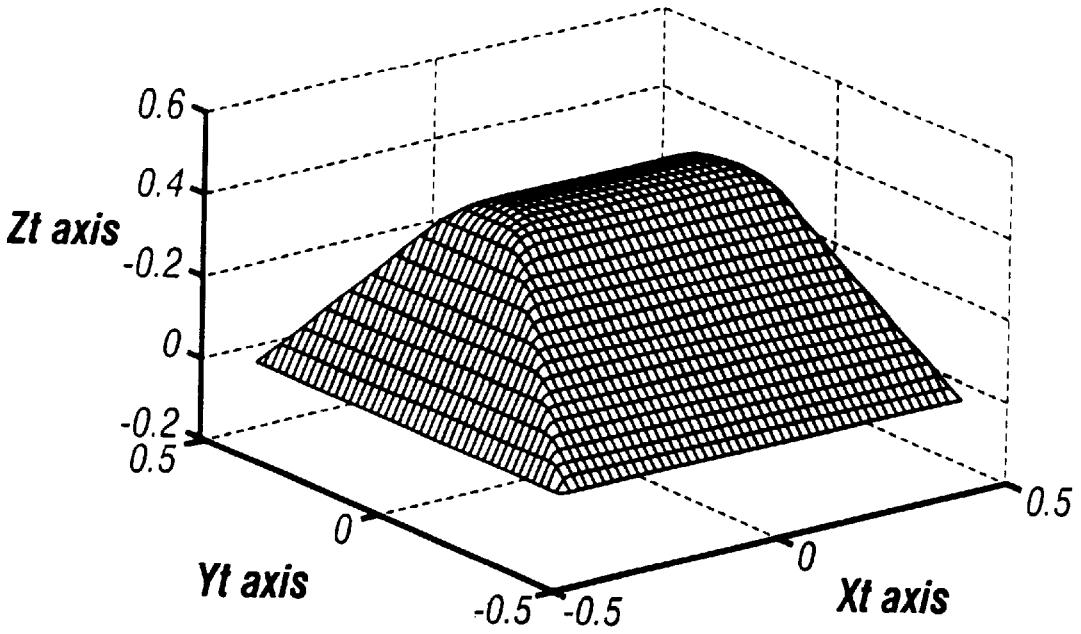
FIG. 13 shows a sample XYZ plot of a non-axisymmetric tooth tip.

FIG. 13 shows a sample XYZ plot of a tooth tip (in tooth local coordinates). Tooth coordinates will be indicated here by the subscript t. (Of course, each tooth has its own tooth coordinate system.) The center of the $X_tY_tZ_t$ coordinate system, in the presently preferred embodiment, is located at the tooth center. The coordinate of a tooth's crest point $P_t$ will be defined by parameters of the tooth profile (e.g. tooth diameter, extension, etc.).

Cone Coordinates

Figure 14:
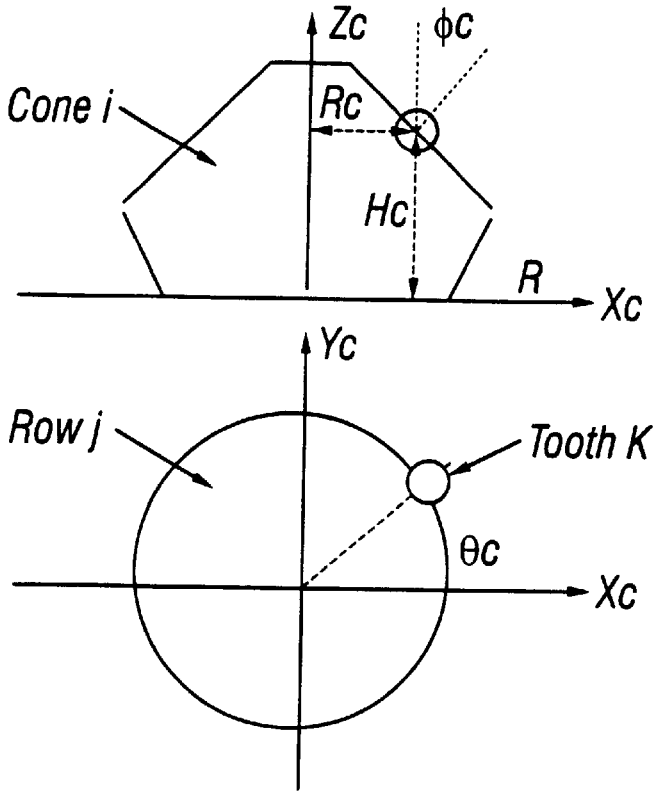
FIG. 14 shows axial and sectional views of the i-th cone, and illustrates the enumeration of rows and teeth.
Figure 15A:
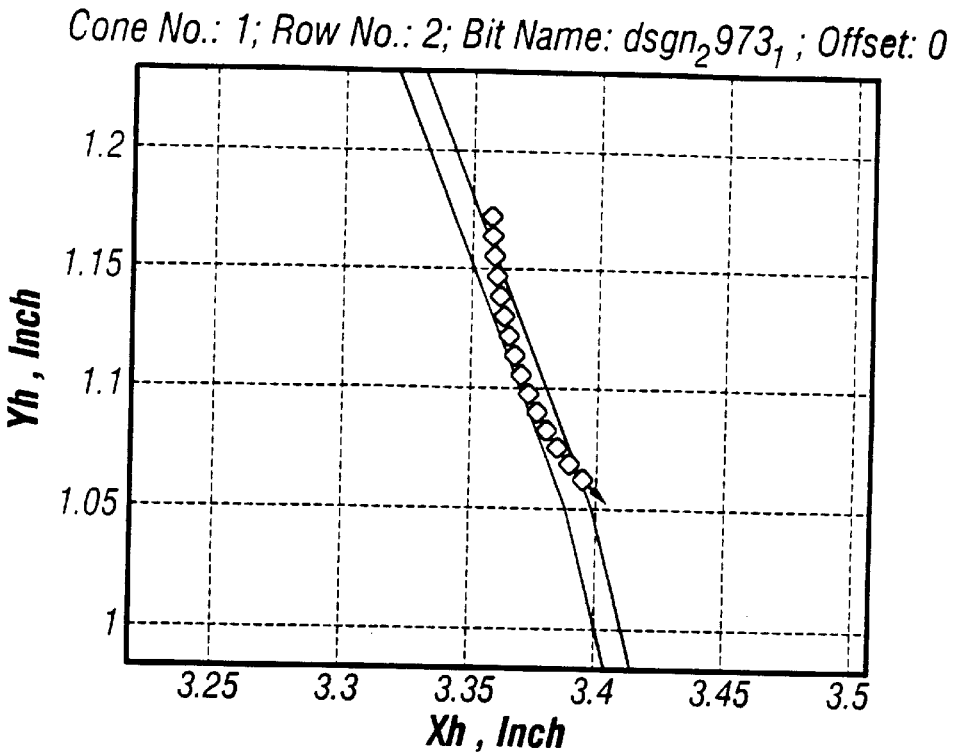
FIGS. 15A–15D show how the planarized tooth trajectories vary as the offset is increased.
Figure 15B:
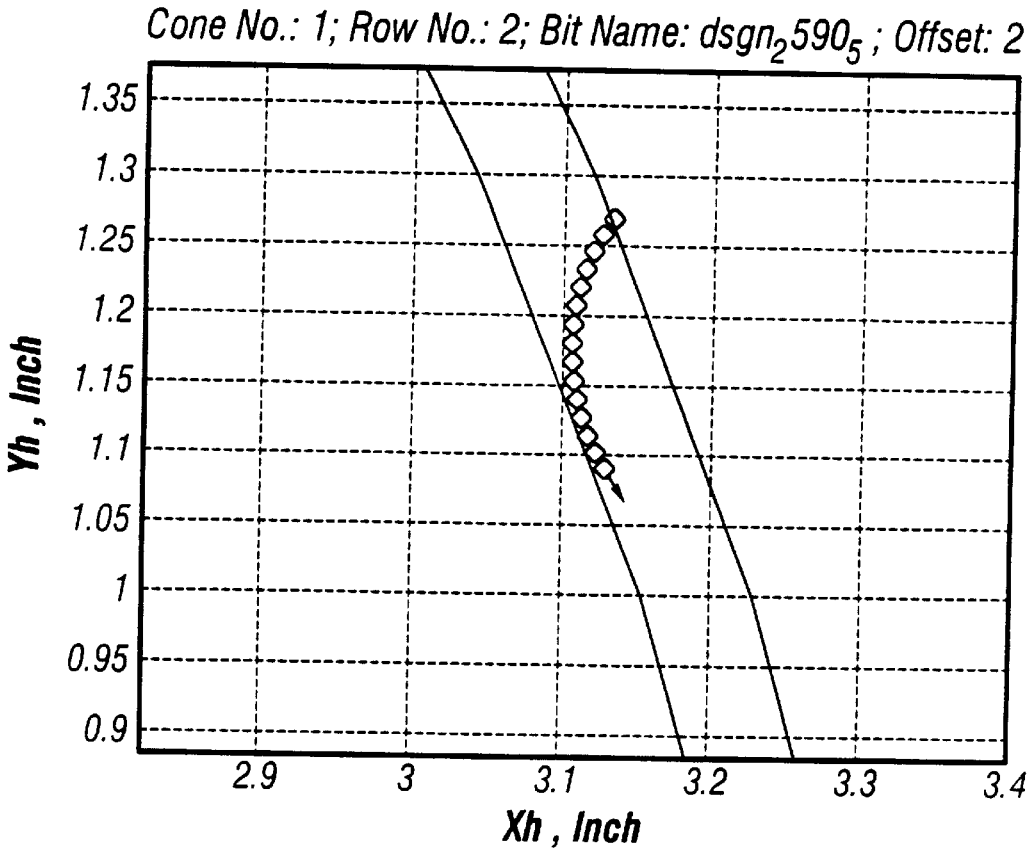
Figure 15C:
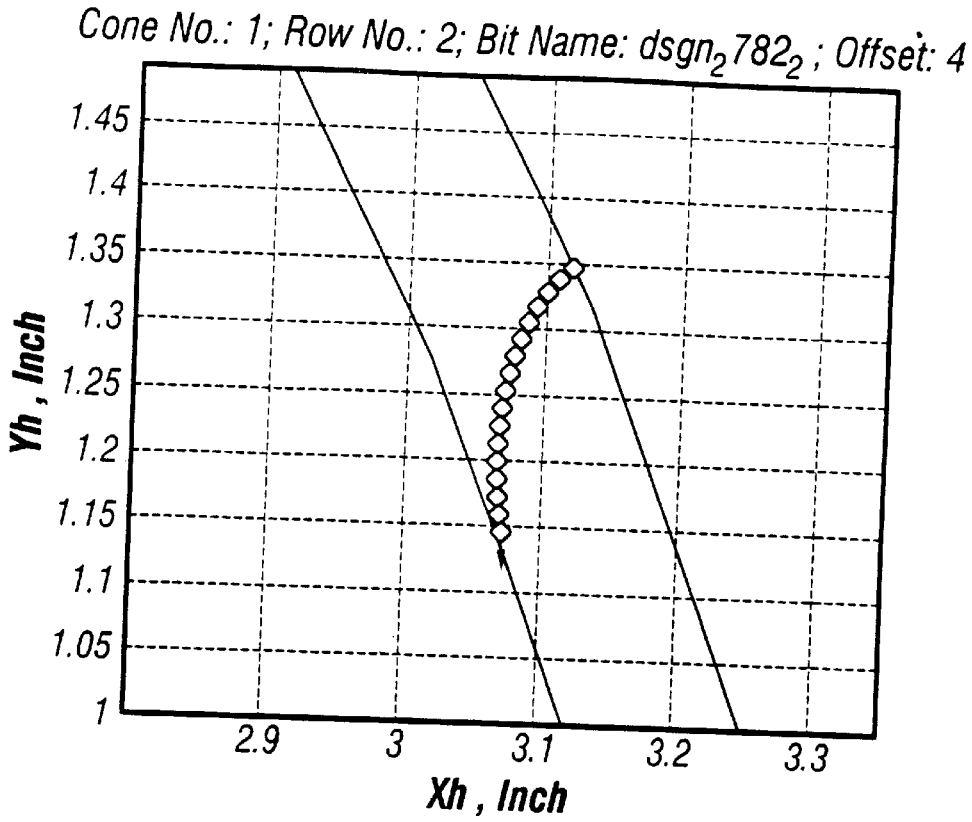
Figure 15D:
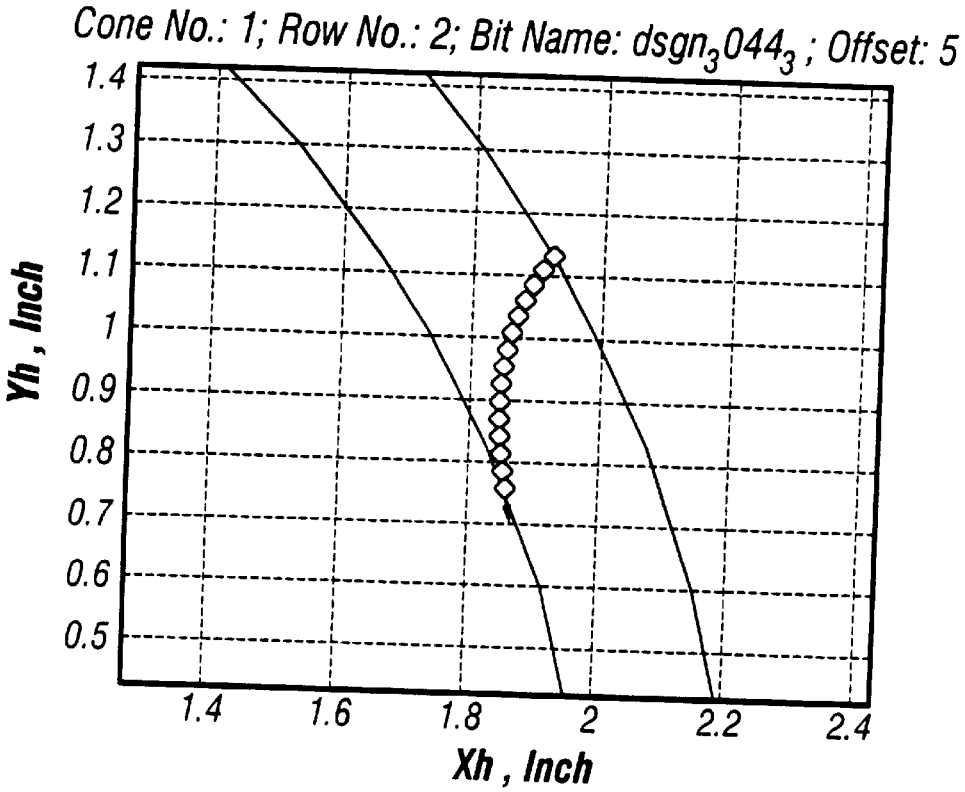
Figure 16A:
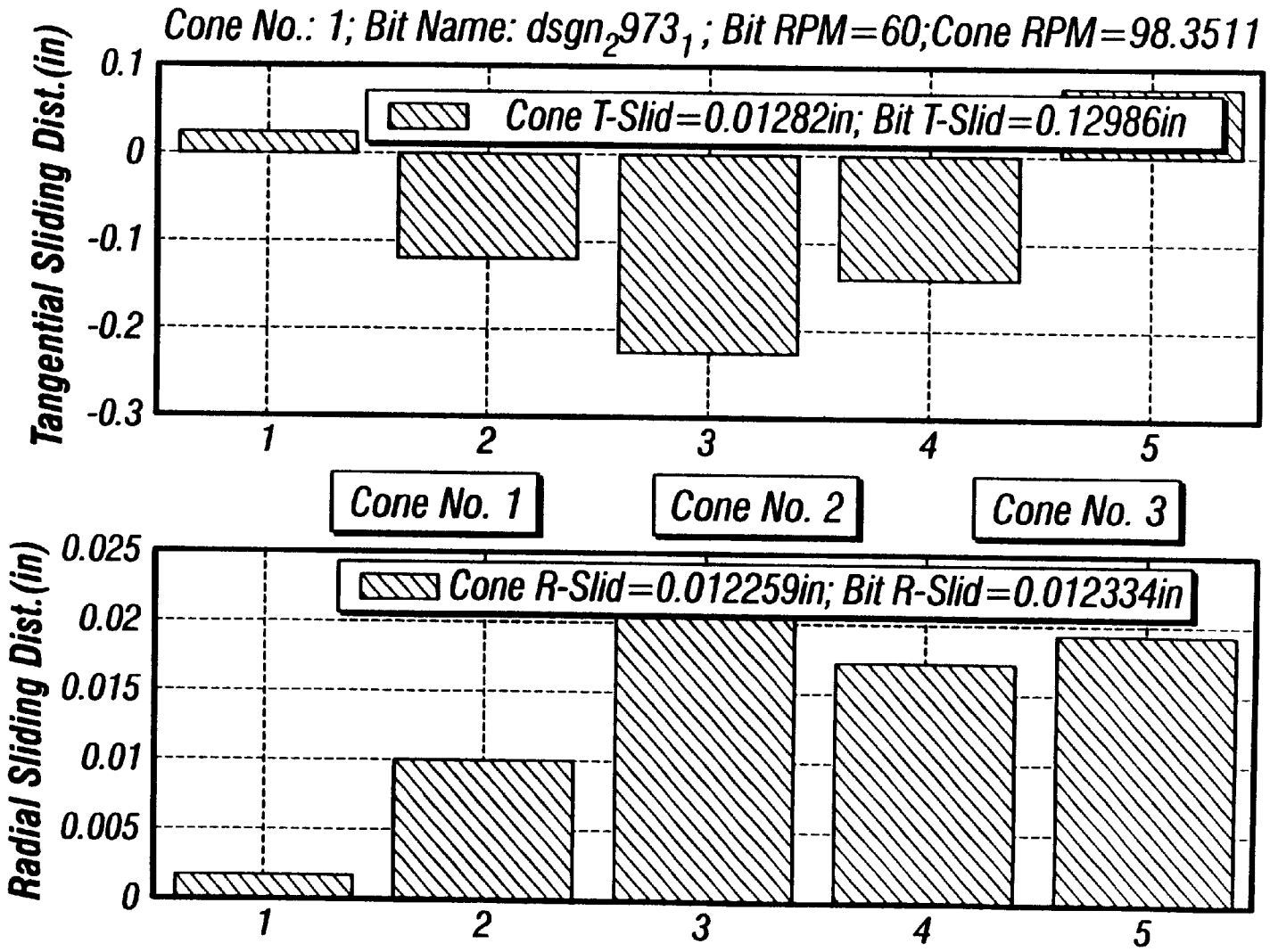
FIGS. 16A–16D show how the ERSD and ETSD values vary for all rows of a given cone as offset is increased.
Figure 16B:
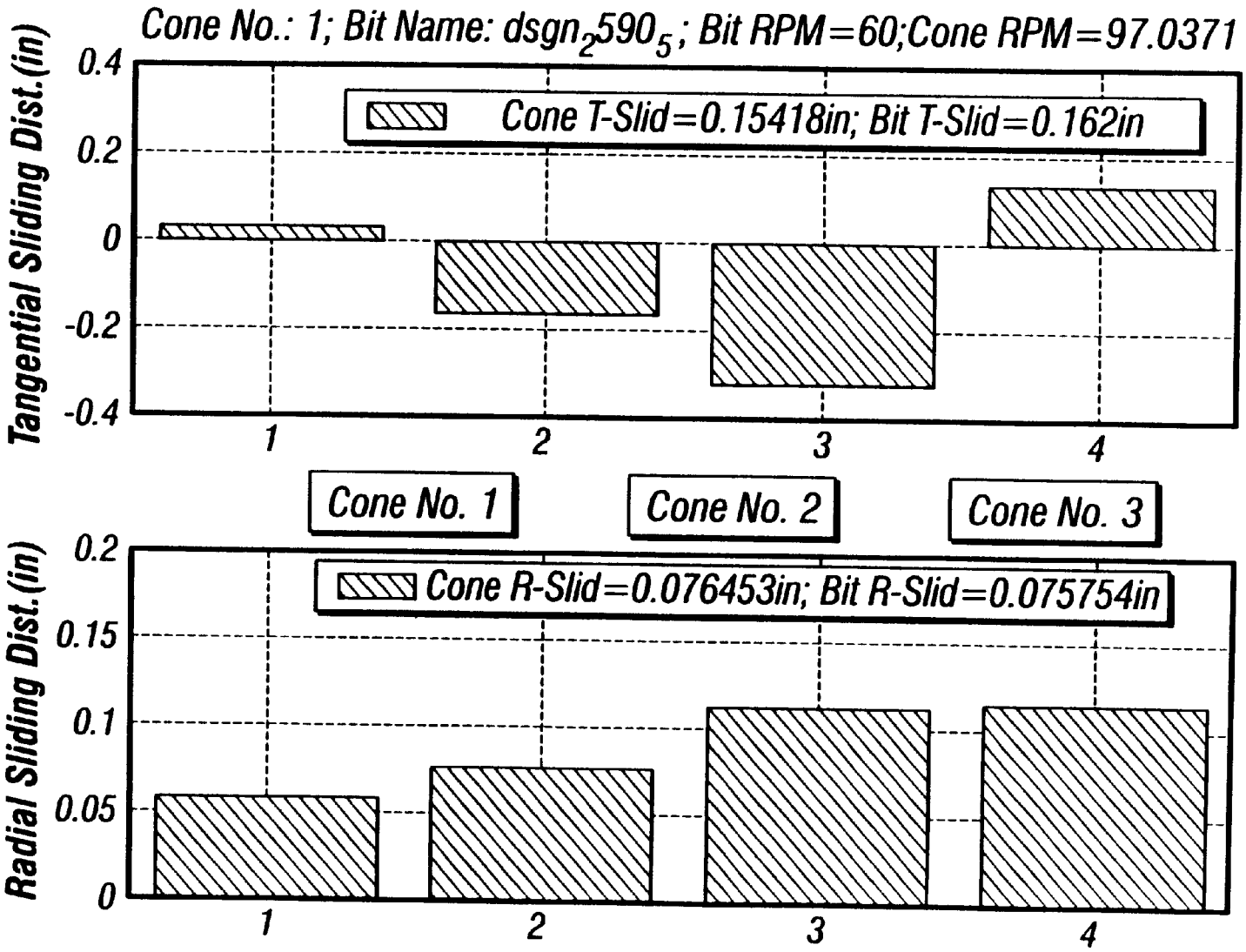
Figure 16C:
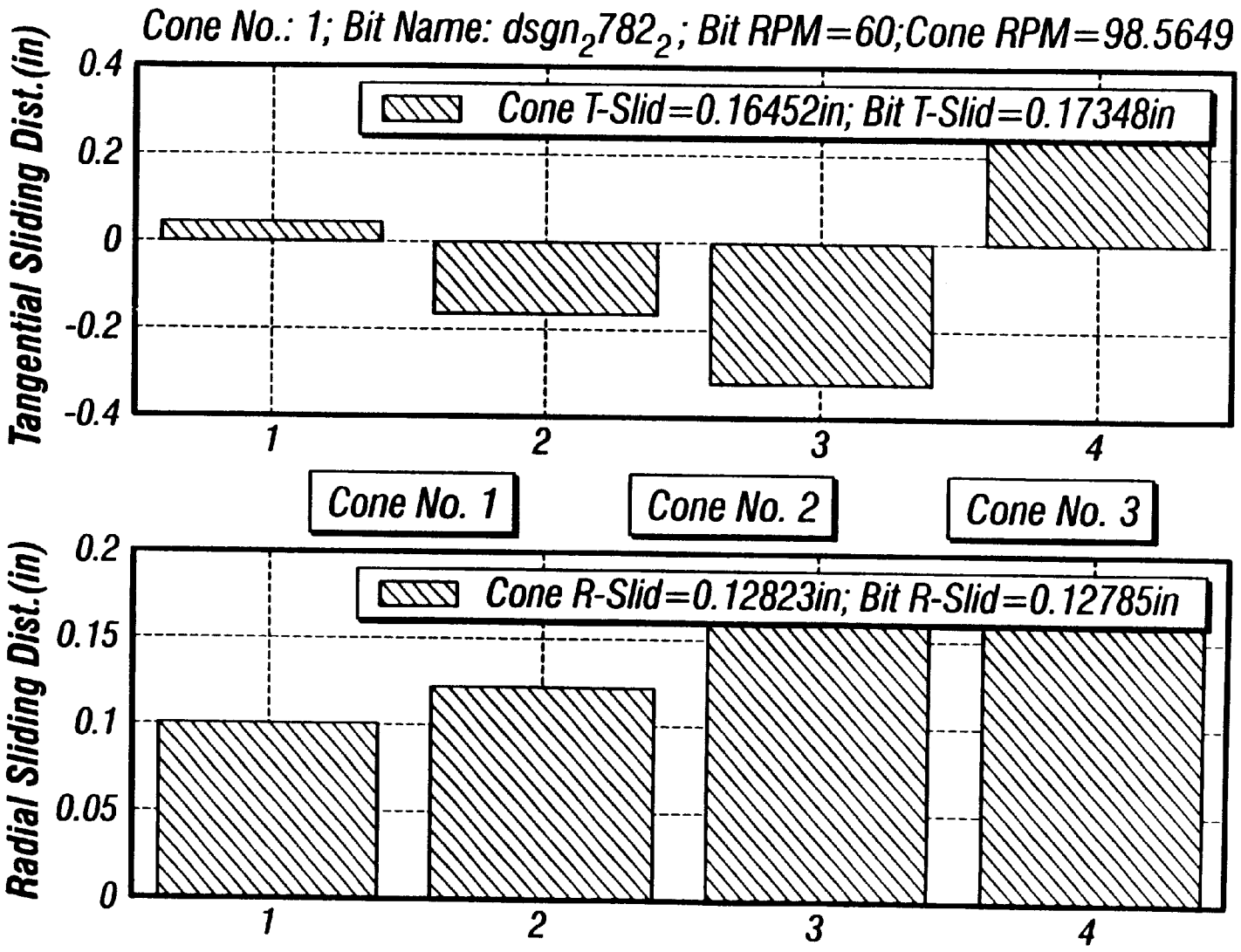
Figure 16D:
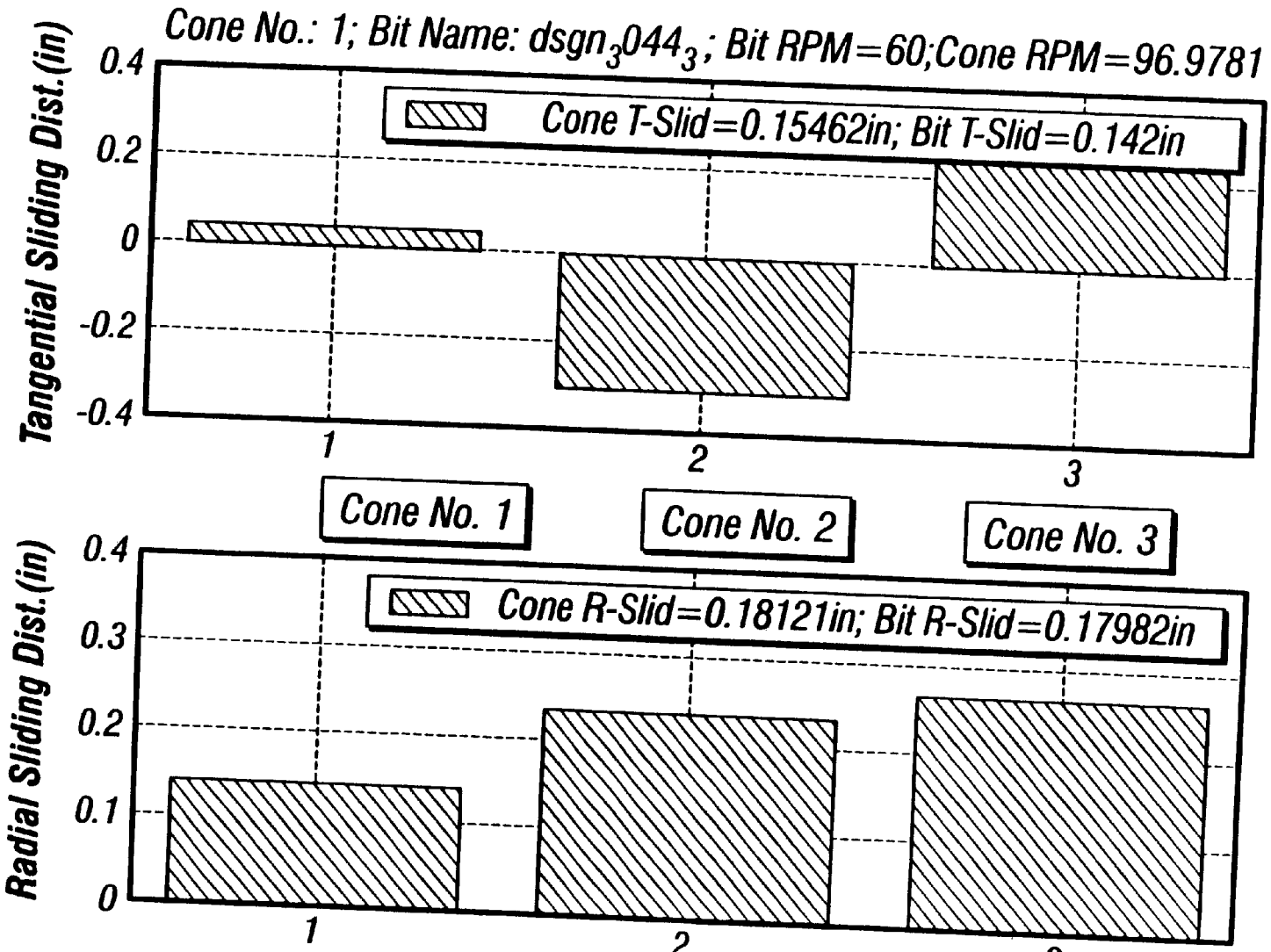

FIG. 14 shows axial and sectional views of the i-th cone, and illustrates the enumeration of rows and teeth. Cone coordinates will be indicated here by the subscript c. The center of the cone coordinates is located in the center of backface of the cone. The cone body is fixed with respect to these coordinates, and hence THESE COORDINATES ROTATE WITH THE CONE. (Of course, each cone has its own cone coordinate system.) The axis $Z_c$ coincides with the cone axis, and is oriented towards to the bit center. Cone axes $Y_c$ and $X_c$, together with axis $Z_c$, follow the right hand rule. As shown in FIG. 13, four parameters are enough to completely define the coordinate of the crest point of a tooth on cone profile. These four parameters are $H_c$, $R_c$, $\phi_c$ and $\phi_c$. For all the teeth on the same row, $H_c$, $R_c$, and $\phi_c$ are the same.

Bit Coordinates

Similarly, a set of bit axes $X_bY_bZ_b$, indicated by the subscript b, is aligned to the bit. The bit is fixed with respect to these coordinates, and hence THESE COORDINATES ROTATE WITH THE BIT. Axis $Z_b$ preferably points toward the cutting face, and axes $X_b$ and $Y_b$ are normal to $Z_b$ (and follow the right-hand rule).

Hole Coordinates

Figure 2:
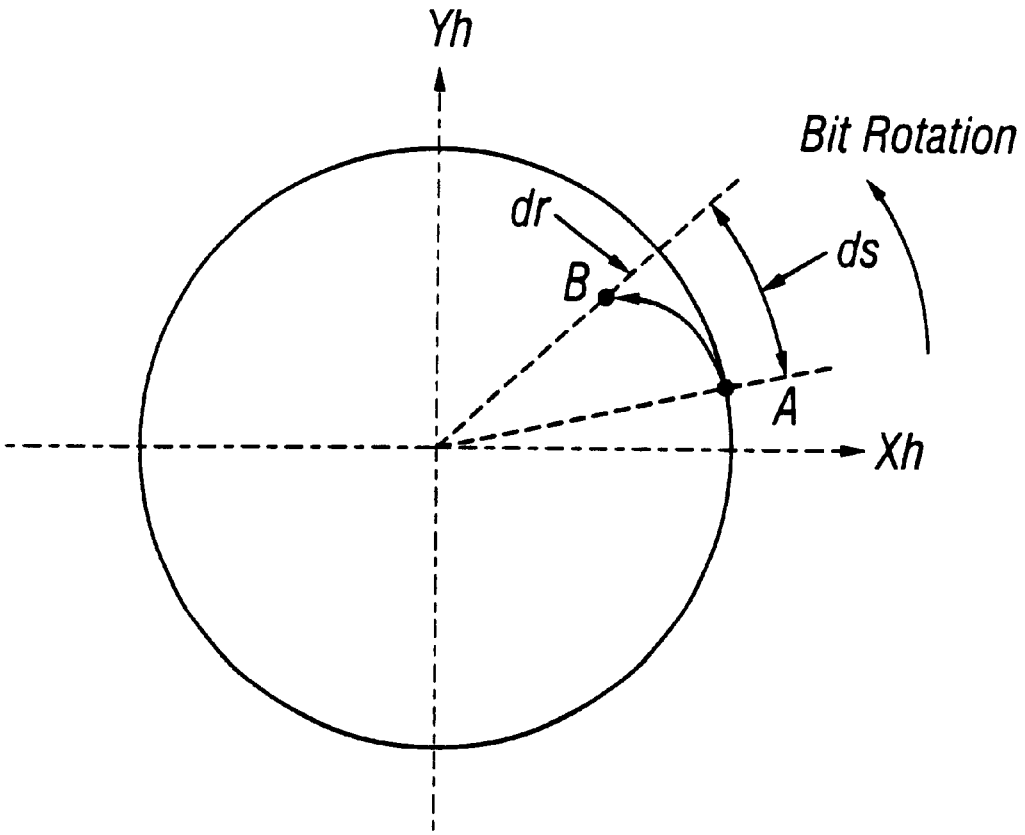
FIG. 2 shows the tangential and radial velocity components of tooth trajectory, viewed through the cutting face (i.e. looking up).

The simplest coordinate system is defined by the hole axes $X_hY_hZ_h$, which are fixed in space. Note however that axes $Z_b$ and $Z_h$ may not be coincident if the bit is tilted. FIG. 2 shows the tangential and radial velocity components of tooth trajectory, viewed through the cutting face (i.e. looking up). Illustrated is a small portion of a tooth trajectory, wherein a tooth's crest (projected into an $X_hY_h$ plane which approximates the bottom of the hole) moves from point A to point B, over an arc distance ds and a radial distance dr.

Transformations

Since all of these coordinate systems are xyz systems, they can be interrelated by simple matrix transformations.

Both the bit and the cones are rotating with time. In order to calculate the position on hole bottom where the crest point of a tooth engages into formation, and the position that the crest point of a tooth disengages from formation, all the teeth positions at any time must be described in hole coordinate system XhYhZh.

The transformation from tooth coordinates $X_tY_tZ_t$, to cone coordinates $X_cY_cZ_c$ can be defined by a matrix Rtc, which is a matrix function of teeth parameters:

$$Rtc=f\,(H_c, R_c, \theta_c\,, \phi_c),$$

so that any point $P_t$ in $X_tY_tZ_t$ can be transformed into local cone coordinates $X_cY_cZ_c$ by:

$$P_c=R_{tc}{*}P_t.$$

At time t=0, it is assumed that the plane $X_cO_cZ_c$ is parallel to the bit axis. At time t, the cone has a rotation angle $\lambda$ around its negative axis ($-Z_c$). Any point on the cone moves to a new position due to this rotation. The new position of $P_c$ in $X_cY_cZ_c$ can be determined by combining linear transforms.

The transform matrix due to cone rotation is $R_{cone}$:

$$R_{cone}=\cos(\lambda)I+(1-\cos(\lambda))NcNc'+\sin(\lambda)Mc,$$

where $N_c$ is the rotation vector and $M_c$ is a 3*3 matrix defined by $N_c$.

Therefore, the new position $P_{crot}$ of $P_c$ due to cone rotation is:

$$P_{crot}=R_{cone}*P_c$$

Let $R_{cb1}$, $R_{cb2}$, and $R_{cb3b}$ be respective transformation matrices (for cones 1, 2, and 3) from cone coordinate to bit coordinates. (These matrices will be functions of bit parameters such as pin angle, offset, and back face length.) Any point $P_{ci}$ in cone coordinates can then be transformed into bit coordinates by:

$$P_b=R_{cbi}*P_{ci}+P_{c0i} \text{ for } i=1, 2, \text{ or } 3,$$

where $P_{c0i}$ is the origin of cone coordinates in the bit coordinate system.

The bit is rotating around its own axis. Let us assume that the bit axes and hole axes are coincident at time t=0. At time t, the bit has a rotation angle $\beta$. The transform matrix due to bit rotation is:

$$Rbh=\cos(\beta)I+(1-\cos(\beta))NbNb'+\sin(\beta)Mb$$

where Nb is the rotation vector and Mb is a 3*3 matrix defined by Nb. Therefore, any point Pb in bit coordinate system can be transformed into the hole coordinate system $X_hY_hZ_h$ by:

$$Ph=Rbh*Pb.$$

Therefore, the position of the crest point of any tooth at any time in three dimensional space has been fully defined by the foregoing seven equations. In order to further determine the engage and disengage point the formation is modeled, in the presently preferred embodiment, by multiple stepped horizontal planes. (The number of horizontal planes depends on the total number of rows in the bit.) In this way, the trajectory of any tooth on hole bottom can be determined.

Calculation of Trajectories in Bottomhole Plane

With the foregoing transformations, the trajectory of the tooth crest across the bottom of the hole can be calculated. FIGS. 3A, 3B, 3C, and 3D show plots of planar tooth trajectories, referenced to the hole coordinates $X_hY_h$, for teeth on four different rows of a particular roller cone bit. The teeth on the outermost row (first row) scrapes toward the leading side of the cone. Its radial and tangential scraping distances are similar, as can be seen by comparing the first bar in FIG. 4A with the first bar in FIG. 4B. However for teeth on the second row the radial scraping motion is much larger than the tangent motion. The teeth on the third row scrape toward the trailing side of the cone, and the teeth on the forth row scrape toward the leading side of the cone.

Figure 4A:
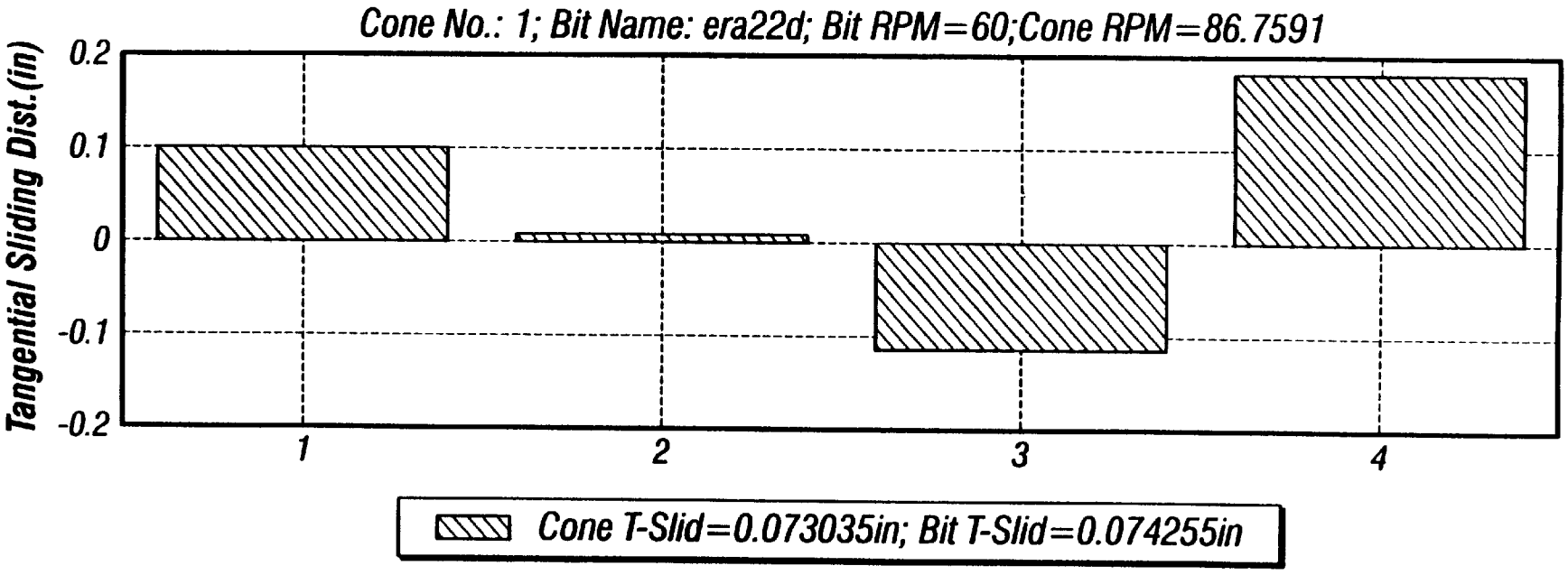
FIGS. 4A and 4B show tangential and radial distances, respectively, for the four tooth trajectories shown in FIGS. 3A–3D.
Figure 4B:
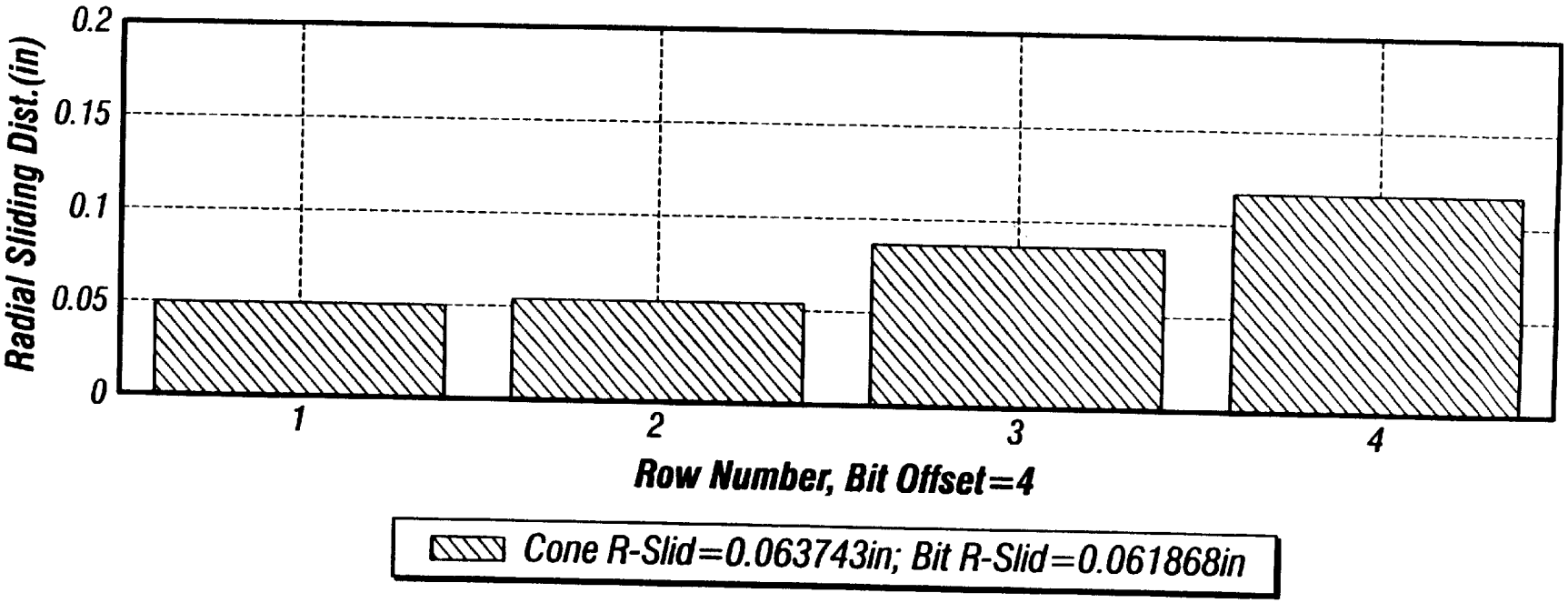

FIGS. 4A and 4B show per-bit-revolution tangential and radial distances, respectively, for the four tooth trajectories shown in FIGS. 3A–3D. Note that, in this example, the motion of the second row is almost entirely radial, and not tangential.

Projection of Trajectories into Cone Coordinates

The tooth trajectories described above are projected on the hole bottom which is fixed in space. In this way it is clearly seen how the tooth scrapes over the bottom. However for the bit manufacturer or bit designer it is necessary to know the teeth orientation angle on the cone coordinate, in order either to keep the elongate side of the tooth perpendicular to the scraping direction (for maximum cutting rate in softer formations) or to keep the elongate side of the tooth in line with the scraping direction (for durability in harder formations). To this end the tooth trajectories are projected to the cone coordinate system. Let $P_1=\{x_1, y_1, Z_1\}_c$ and $P_2=\{x_2, Y_2, z_2\}_c$ be the engage and disengage points on cone coordinate system, respectively, and approximate the tooth trajectory $P_1$–P2 as a straight line. Then the scraping angle in cone coordinates is:

$$R_s=\sqrt{(x_{2-x_1})^2+(y_1+y_2)^2}$$

and $$\gamma_s = \tan^{-1}\left(\frac{R_s}{z_2 - z_1}\right)$$

The teeth can then be oriented appropriately with respect to this angle gamma. For example, for soft formation drilling the tooth would preferably be oriented so that its broad side is perpendicular to the scraping direction, in order to increase its rate of rock removal. In this case, the direction $\gamma_c$ of the elongate crest of the tooth, in cone coordinates, is normal to $\gamma_s$, i.e. $\gamma_c=\gamma_s+\pi/2$. Conversely, for drilling harder formations with a chisel-shaped tooth it might be preferable to orient the tooth with minimum frontal area in the direction of scraping, i.e. with $y_c=y_s$.

Derivation of Equivalent Radial and Tangential Scraping

There are numerous parameters in roller cone design, and experienced designers already know, qualitatively, that changes in cone shape (cone angle, heel angle, third angle, and oversize angle) as well as offset and journal angle will affect the scraping pattern of teeth in order to get a desired action-bottom. One problem is that it is not easy to describe a desired action-on-bottom quantitatively. The present application provides techniques for addressing this need.

Two new parameters have been defined in order to quantitatively evaluate the cone shape and offset effects on tooth scraping motion. Both of these parameters can be applied either to a bit or to individual cones.

(1) Equivalent Tangent Scraping Distance (ETSD) is equal to the total tangent scraping distance of all teeth on a cone (or bit) divided by the total number of the teeth on the cone (or bit).

(2) Equivalent Radial Scraping Distance (ERSD) is equal to the total radial scraping distance of all teeth on a cone (or bit) divided by the total number of the teeth on the cone (or bit).

Both of these two parameters they have much more clear physical meaning than the offset value and cone shape.

Surprisingly, the arcuate (or bulged) shape of the cone primarily affects the ETSD value, and the offset determines the ERSD value. Also surprisingly, the ERSD is not equal to zero even at zero offset.

In other words, the teeth on a bit without offset may still have some small radial scraping effects.

The radial scraping direction for all teeth is always toward to the hole center (positive). However, the tangential scraping direction is usually different from row to row.

In order to use the scraping effects fully and effectively, the leading side of the elongated teeth crest should be orientated at an angle to the plane of the cone's axis, which is calculated as described above for any given row.

FIG. 2 shows the procedure in which a tooth cuts into (point A) and out (point B) the formation. Due to bit offset, arcuate cone shape and bit and cone rotations, the motion from A to B can be divided into two parts: tangent motion ds and radial motion dr. Notice the tangent and radial motions are defined in hole coordinate system XhYh. Because ds and dr vary from row to row and from cone to cone, we derive an equivalent tangent scraping distance (ETSD) and an equivalent radial scraping distance (ERSD) for a whole cone (or for an entire bit).

For a cone, we have $$ETSD = \frac{\sum_{j}^{Nr} ds_j Nt_j}{Nc}$$

and $$ERSD = \frac{\sum_{j}^{Nr} dr_j Nt_j}{Nc}$$

where Nc is the total tooth count of a cone and Nr is the number of rows of a cone.

Similarly for a bit, we have $$ETSD = \frac{\sum_{i}^{3}\sum_{j}^{Nr} ds_{ij} Nt_{ij}}{Nb}$$

and $$ERSD = \frac{\sum_{i}^{3}\sum_{j}^{Nr} dr_{ij} Nt_{ij}}{Nb}$$

where Nb is the total tooth count of the bit.

FIGS. 15A–15D show how the planarized tooth trajectories vary as the offset is increased. These figures clearly show that with the increase of the offset value, the radial scraping distance is increased. Surprisingly, the radial scraping distance is not equal to zero even if the offset is zero. This is due to the arcuate shape of the cone.

Figure 6:
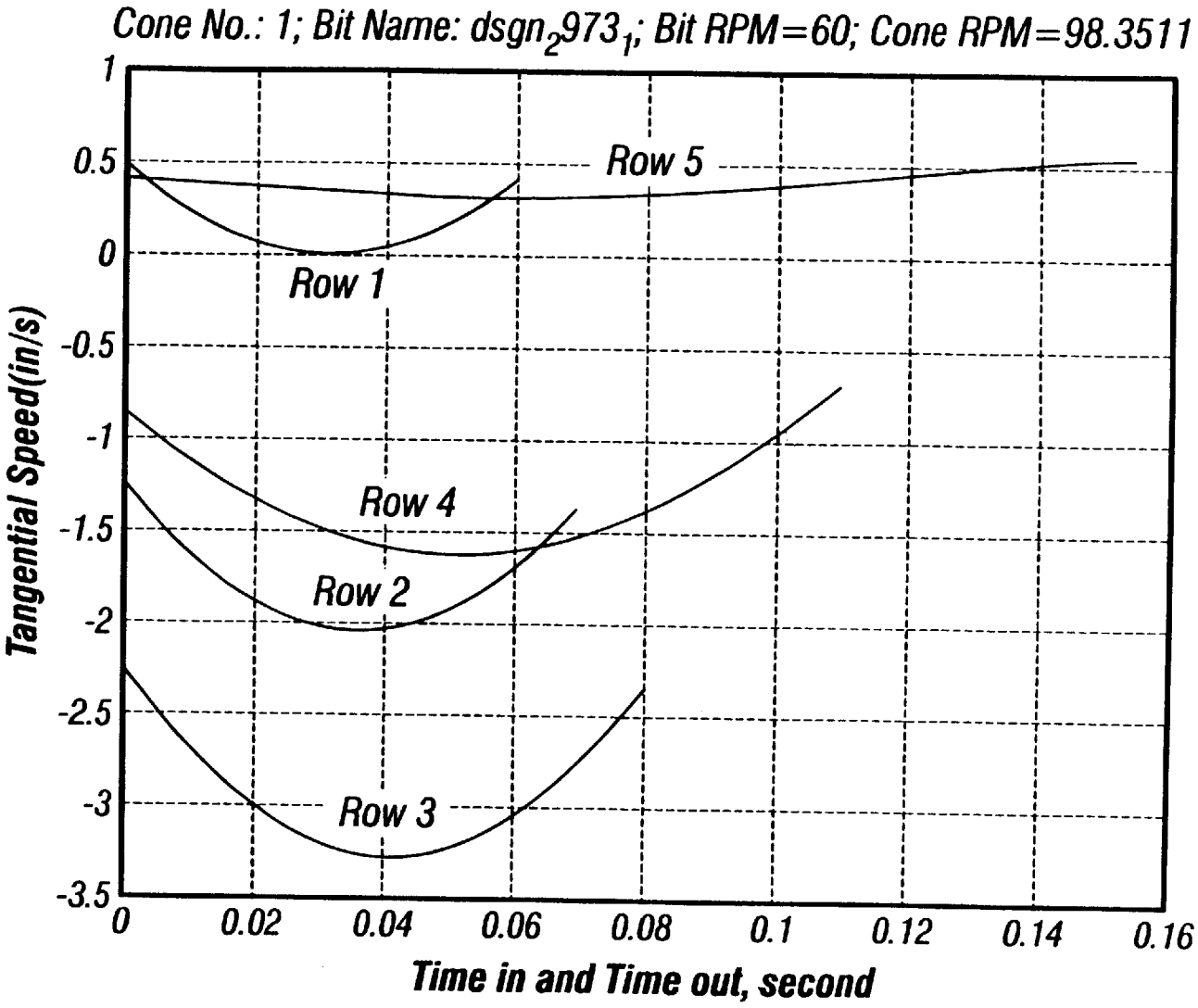
FIG. 6 shows time-domain plots of tooth tangential speed, for the five rows of a sample cone, over the duration of the trajectory for each row.

FIGS. 16A–16D show how the ERSD and ETSD values vary for all rows of a given cone as offset is increased. From these Figures, it can be seen that the tangent scraping distance of the gage row, while very small compared to other rows but is not equal to zero. It means that there is a sliding even for the teeth on the driving row. This fact may be explained by looking at the tangent speed during the entry and exit of teeth into and out of the rock. (FIG. 6 shows time-domain plots of tooth tangential speed, for the five rows of a sample cone, over the duration of the trajectory for each row.) During the cutting procedure the tangent speed is not equal to zero except for one instant. Because the sliding speed changes with time, the instantaneous speed is not the best way to describe the teeth/rock interaction.

Figure 5:
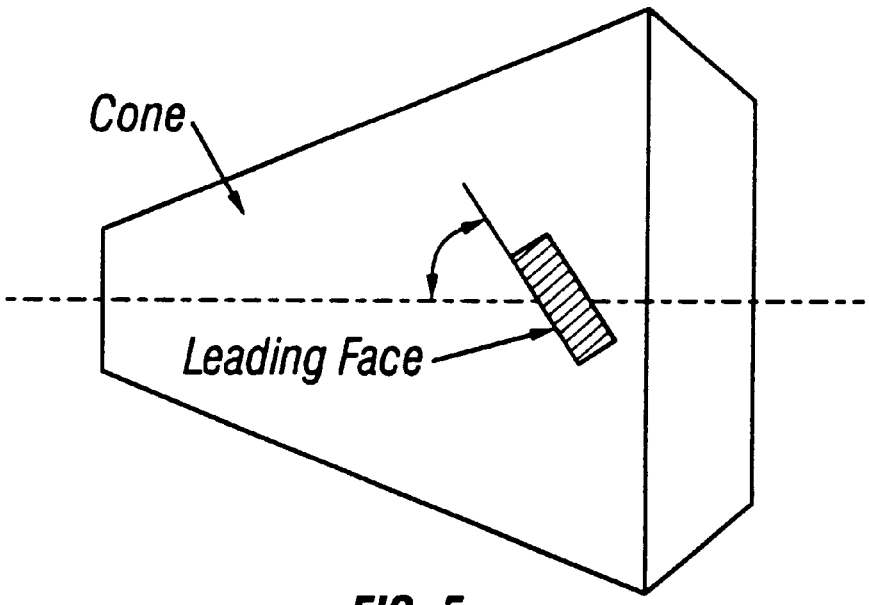
FIG. 5 is a sectional view of a cone (normal to its axis), showing how the tooth orientation is defined.
Figure 3A:
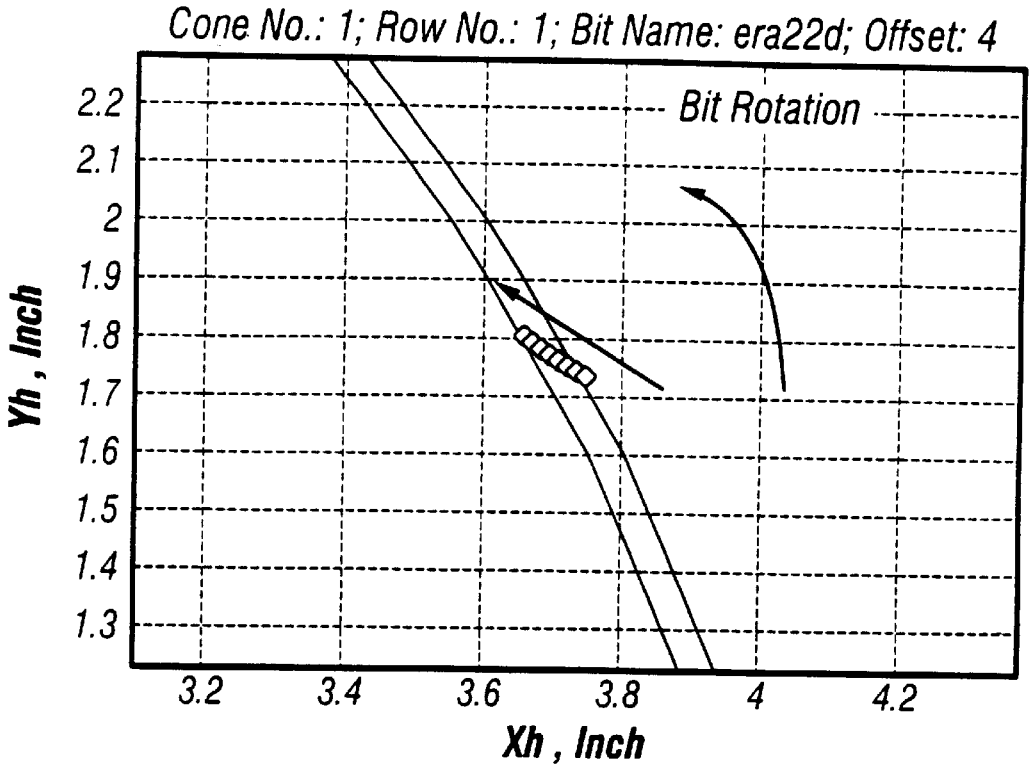
FIGS. 3A, 3B, 3C, and 3D show plots of planar tooth trajectories for teeth in four rows of a single cone, referenced to the XY coordinates of FIG. 2.
Figure 3B:
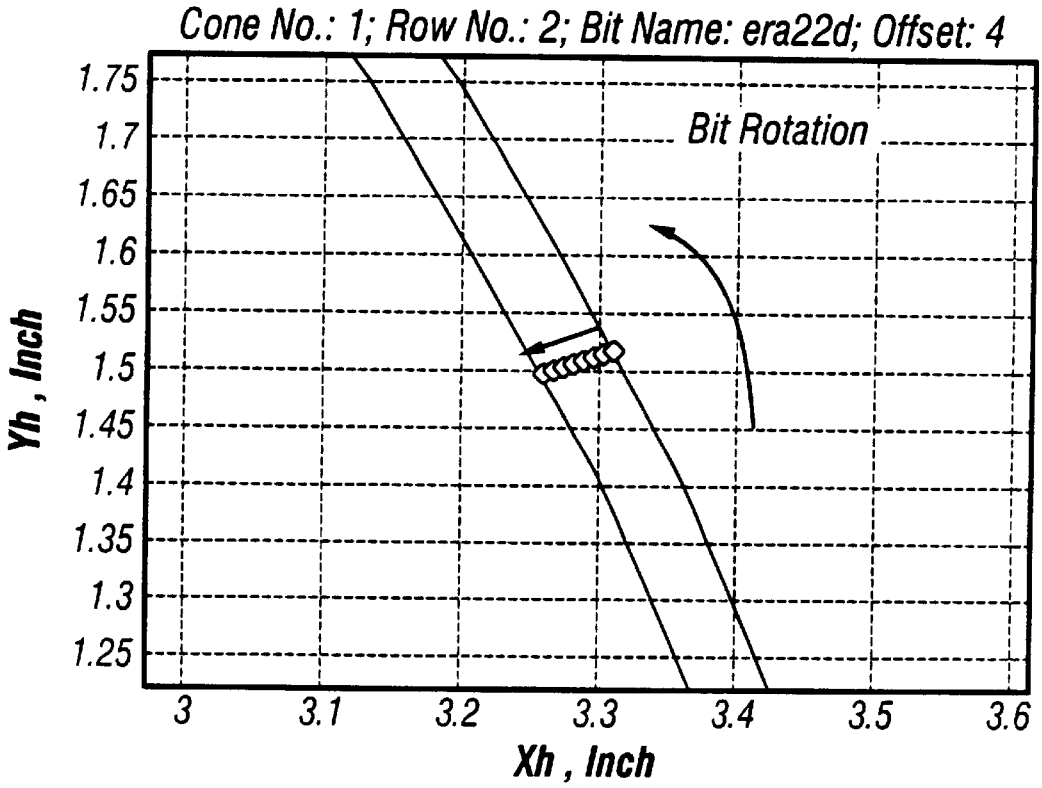
Figure 3C:
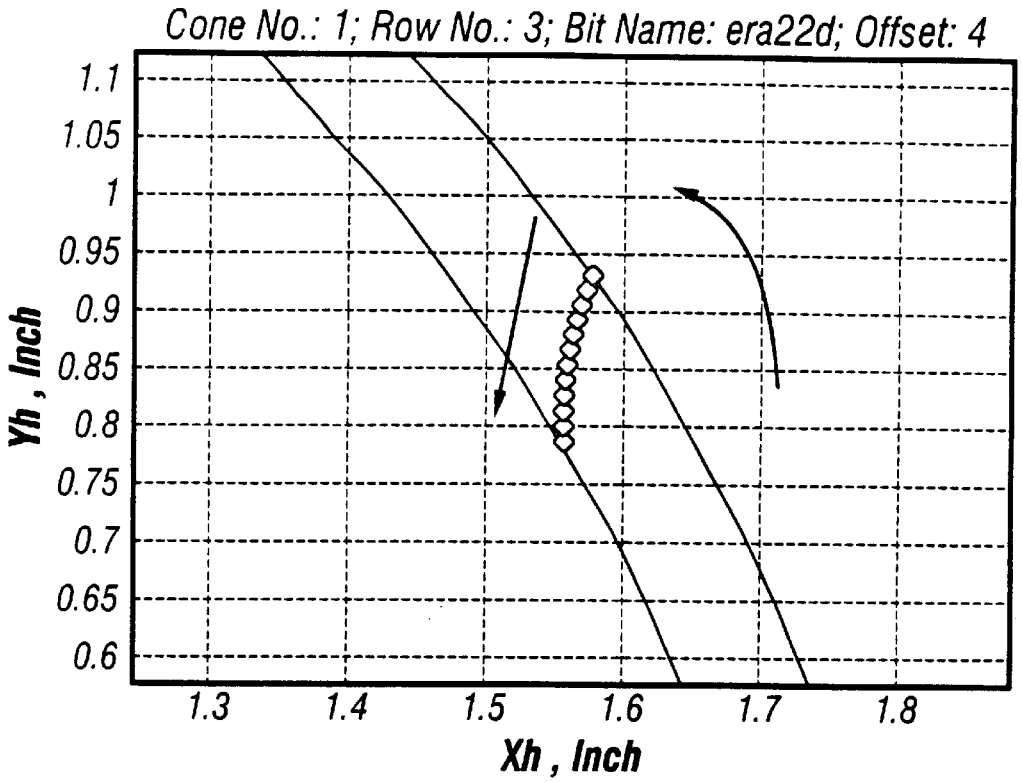
Figure 3D:
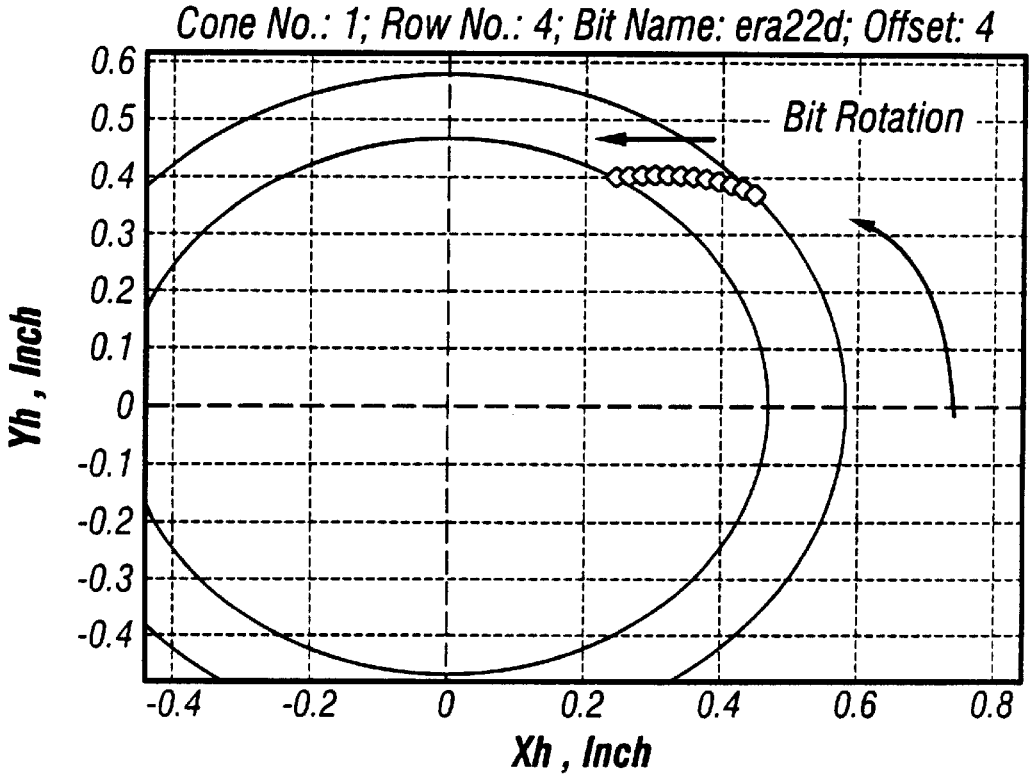

Note that the tangent scraping directions are different from row to row for the same cone. FIG. 5 is a sectional view of a cone (normal to its axis), showing how the tooth orientation is defined in the present application: the positive direction is defined as the same direction as the bit rotation. This means that the leading side of tooth on one row may be different from that on another row.

The ERSD increases almost proportionally with the increase of the bit offset. However, ERSD is not zero even if the bit offset is zero. This is because the radial sliding speed is not always zero during the procedure of tooth cutting into and cutting out the rock.

Calculation of Uncut Rings, and Row Position Adjustment

Figure 7A:
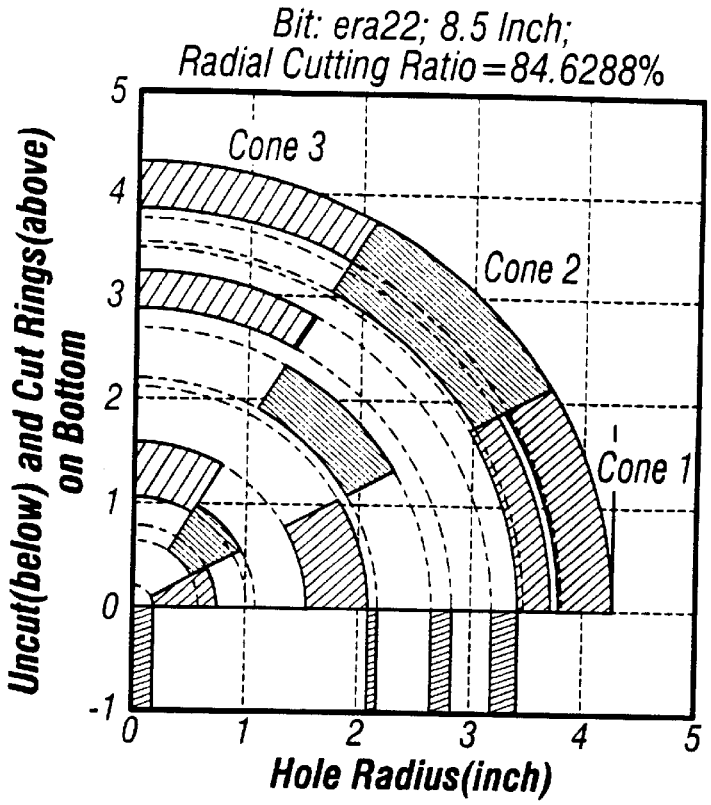
FIGS. 7A and 7B show how optimization of tooth orientation can perturb the width of uncut rings on the hole bottom.
Figure 7B:
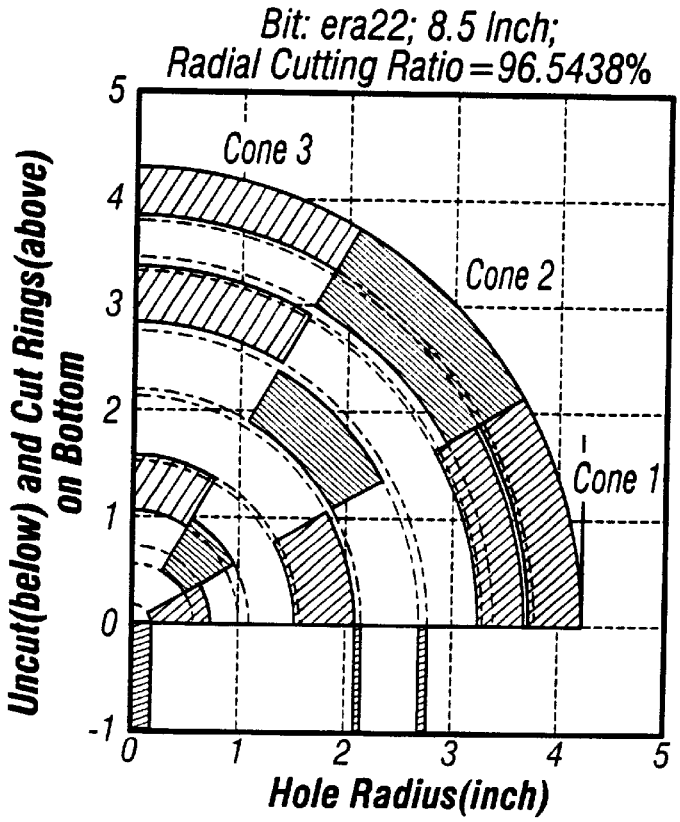

FIGS. 7A and 7B show how optimization of tooth orientation can perturb the width of uncut rings on the hole bottom. The width of uncut rings is one of the design constraints: a sufficiently narrow uncut ring will be easily fractured by adjacent cutter action and mud flows, but too large an uncut ring will slow rate of penetration. Thus one of the significant teachings of the present application is that tooth orientation should not be adjusted in isolation, but preferably should be optimized jointly with the width of uncut rings.

Interference Check

Figure 8A:
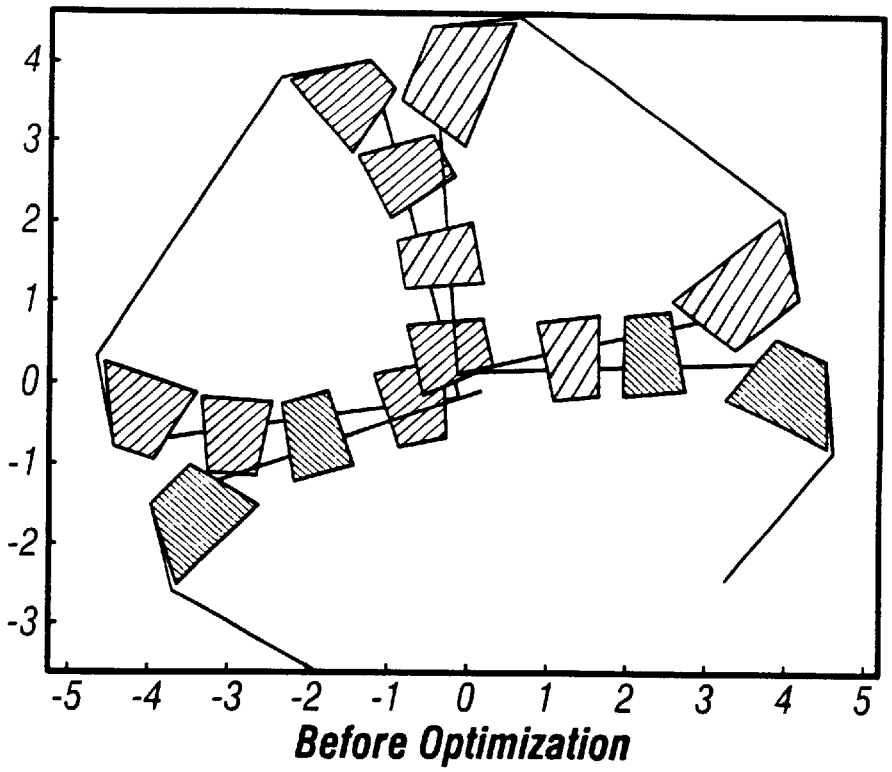
FIGS. 8A and 8B show how optimization of tooth orientation can disturb the tooth clearances.
Figure 8B:
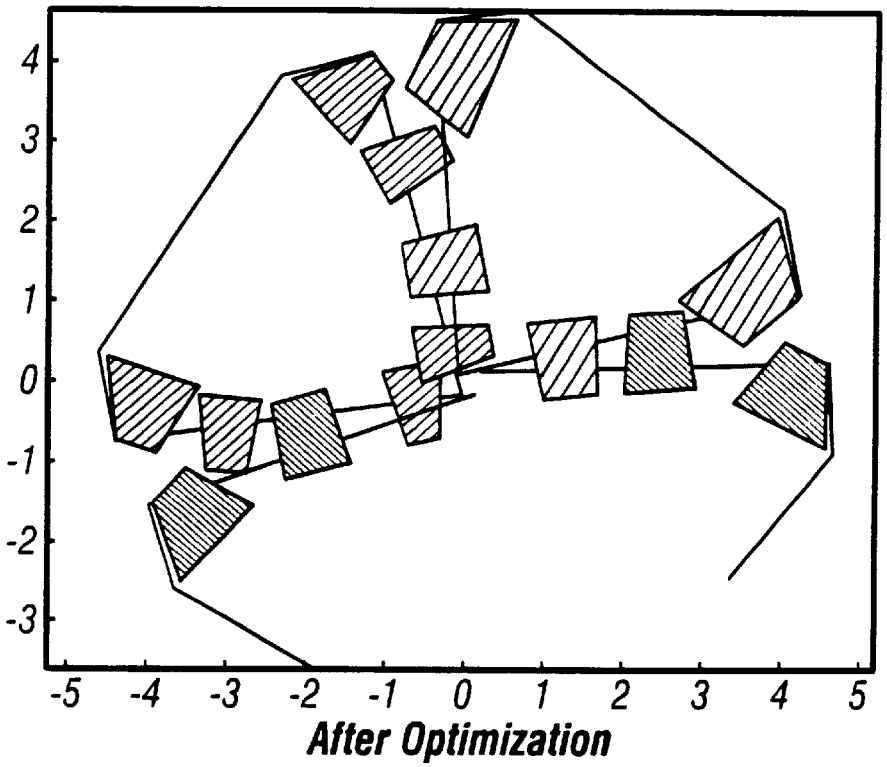

Another constraint is tooth interference. In the crowded geometries of an optimized roller cone design, it is easy for an adjustment to row position to cause interference between cones. FIGS. 8A and 8B graphically show how optimization of tooth orientation can disturb the tooth clearances. Thus optimization of tooth orientation is preferably followed by an interference check (especially if row positions are changed).

Iteration

Preferably multiple iterations of the various optimizations are used, to ensure that the various constraints and/or requirements are all jointly satisfied according to an optimal tradeoff.

Graphic Display

The scraping motion of any tooth on any row is visualized on the designer's computer screen. The bit designer has a chance to see quantitatively how large the motion is and in which direction if bit geometric parameters like cone shape and offset are changed.

Figure 9A:
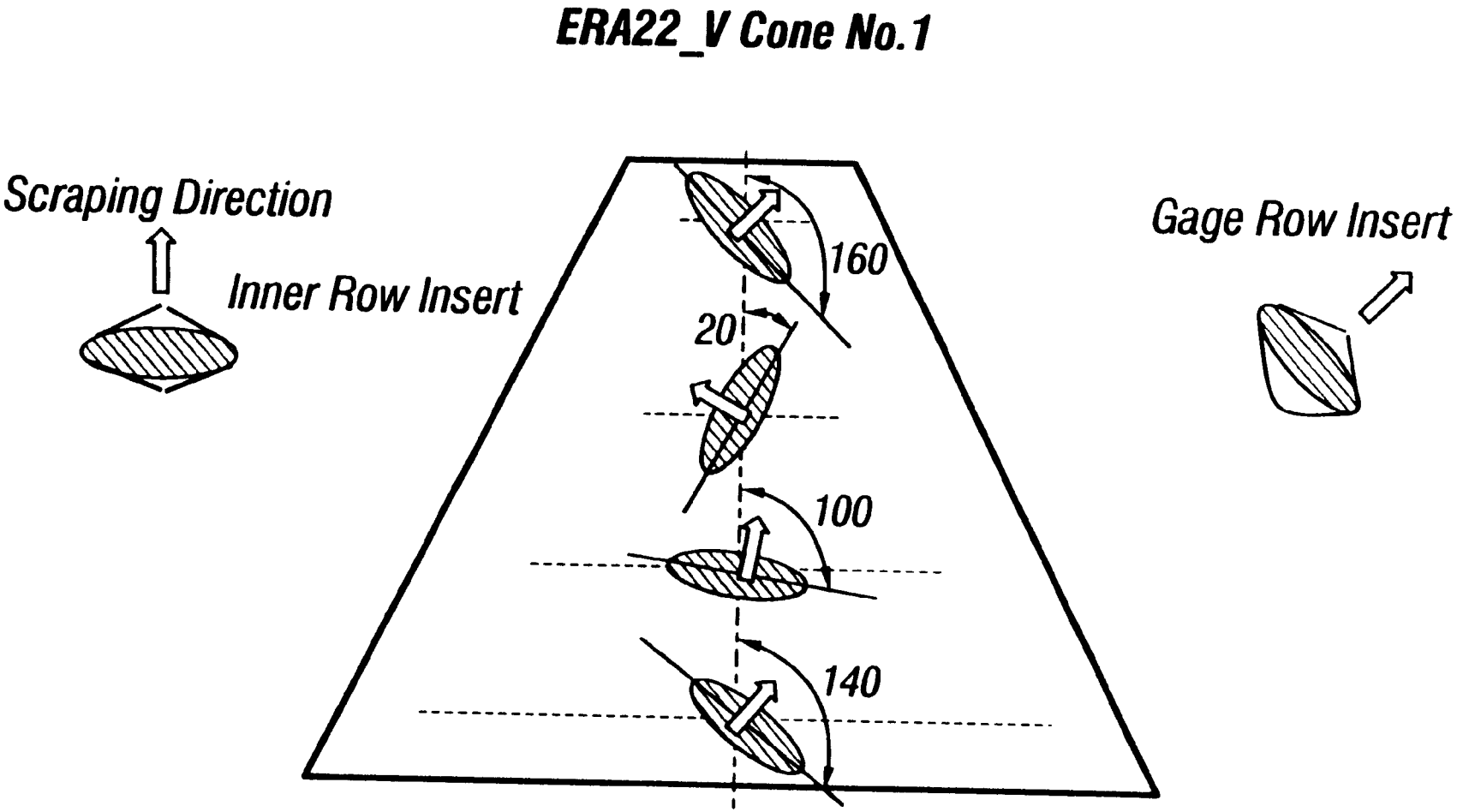
FIGS. 9A, 9B and 9C show the screen views which a skilled bit designer would see, according to some embodiments of the invention, while working on a bit optimization which included optimization of tooth orientation.
Figure 9B:
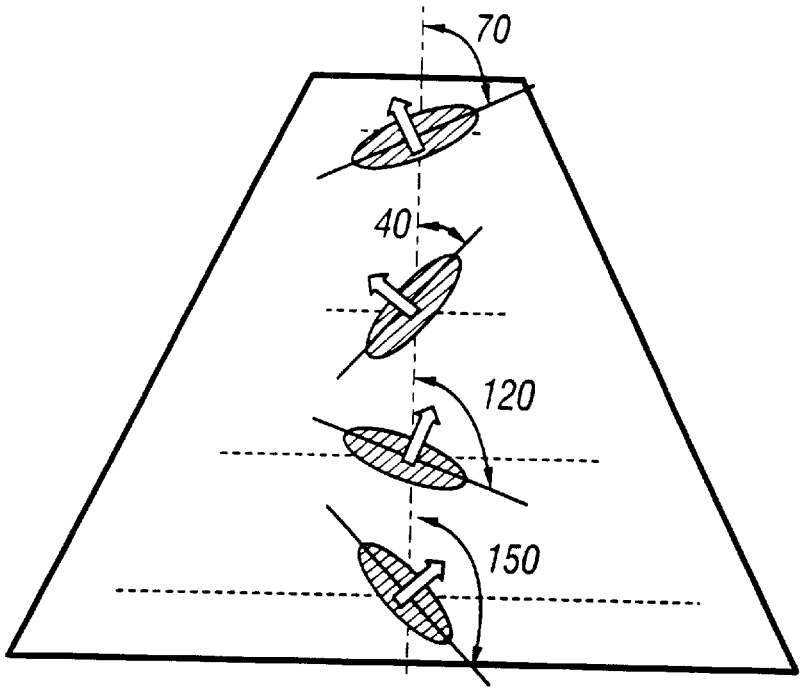
Figure 9C:
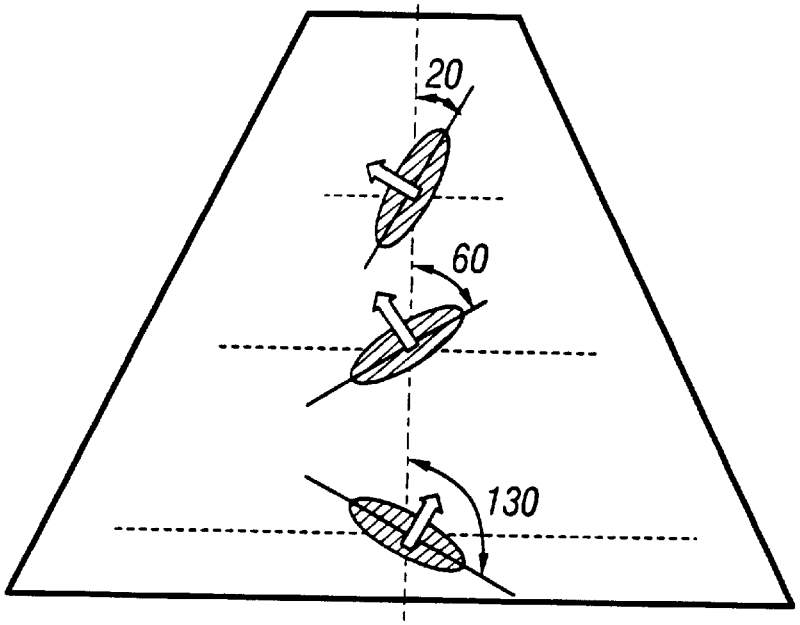
Figure 10:
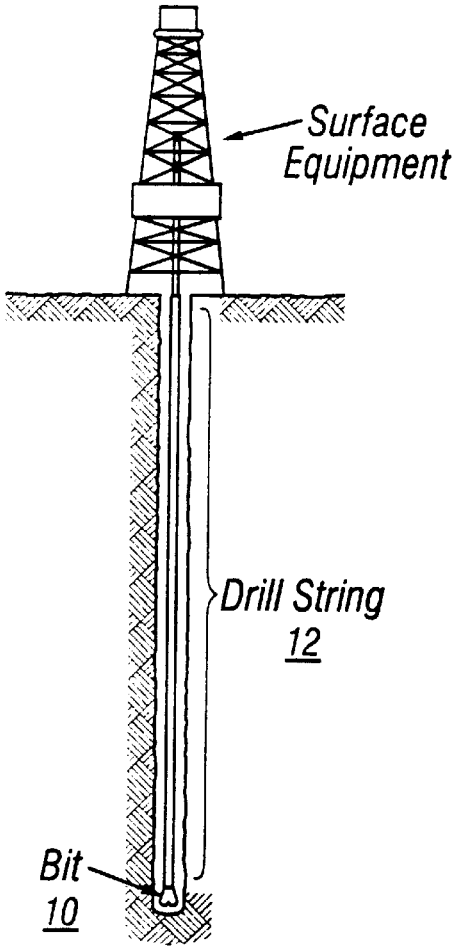
FIG. 10 shows a drill rig in which bits optimized by the teachings of the present application can be advantageously employed.
Figure 11:
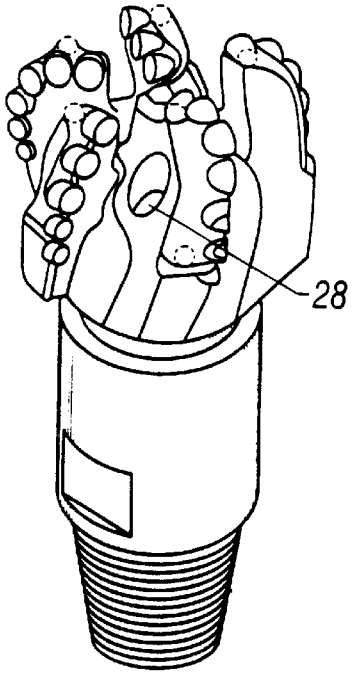
FIG. 11 shows a conventional roller cone bit.
Figure 12:
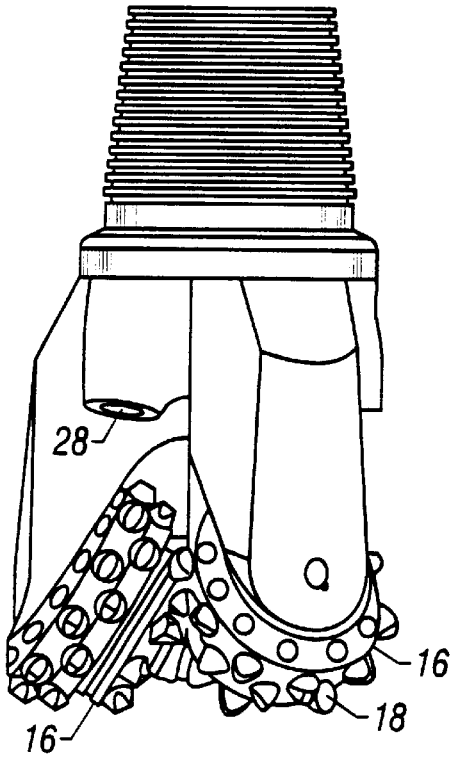
FIG. 12 shows a conventional drag bit.

FIGS. 9A, 9B and 9C show the screen views which a skilled bit designer would see, according to some embodiments of the invention, while working on a bit optimization which included optimization of tooth orientation. These three views show representations of tooth orientation and scraping direction for each tooth row on each of the three cones. This simple display allows the designer to get a feel for the effect of various parameter variations Calculation of Cone/Bit Rotation Ratio The present application also teaches that the ratio between the rotational speeds of cone and bit can be easily checked, in the context of the detailed force calculations described above, simply by calculating the torques about the cone axis. If these torques sum to zero (at a given ratio of cone and bit speed), then the given ratio is correct. If not, an iterative calculation can be performed to find the value of this ratio.

However, it should be noted that the exact calculation of the torque on the cones is dependent on use of a solid-body tooth model, as described above, rather than a mere point approximation.

Previous simulations of roller cone bits have assumed that the gage row is the "driving" row, which has no tangential slippage against the cutting face. However, this is a simplification which is not completely accurate. Accurate calculation of the ratio of cone speed to bit speed shows that it is almost never correct, if multiple rows of teeth are present, to assume that the gage row is the driver.

Changes in the tooth orientation angle will not themselves have a large immediate effect on the cone speed ratio. However, the tooth orientation affects the width of uncut rings, and excessive uncut ring width can require the spacing of tooth rows to be changed. Any changes in the spacing of tooth rows will probably affect the cone speed ratio.

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

Drag bit: a drill bit with no moving parts that drills by intrusion and drag.

Mud: the liquid circulated through the wellbore during rotary drilling operations, also referred to as drilling fluid. Originally a suspension of earth solids (especially clays) in water, modern "mud" is a three-phase mixture of liquids, reactive solids, and inert solids.

Nozzle: in a passageway through which the drilling fluid exits a drill bit, the portion of that passageway which restricts the cross-section to control the flow of fluid.

Orientation: the angle of rotation with which a non-axisymmetric tooth is inserted into a cone. Note that a tooth which is axisymmetric (e.g. one having a hemispherical tip) cannot have an orientation.

Roller cone bit: a drilling bit made of two, three, or four cones, or cutters, that are mounted on extremely rugged bearings. Also called rock bits. The surface of each cone is made up of rows of steel teeth (generally for softer formations) or rows of hard inserts (typically of tungsten carbide) for harder formations.

According to a disclosed class of innovative embodiments, there is provided: A method of designing a roller cone bit, comprising the steps of: adjusting the orientation of at least one tooth on a cone, in dependence on an expected trajectory of said tooth through formation material at the cutting face, in dependence on an estimated ratio of cone rotation to bit rotation; recalculating said ratio, if the location of any row of teeth on said cone changes during optimization; recalculating the trajectory of said tooth in accordance with a recalculated value of said cone speed; and adjusting the orientation of said tooth again, in accordance with a recalculated value of said tooth trajectory.

According to another disclosed class of innovative embodiments, there is provided: A method of designing a roller cone bit, comprising the steps of: calculating the trajectory of at least one tooth on each cone through formation material at the cutting face; and jointly optimizing both the orientations of said teeth and the width of uncut rings on said cutting face, in dependence on said trajectory.

According to another disclosed class of innovative embodiments, there is provided: A method of designing a roller cone bit comprising the steps of: a) adjusting the orientation of at least one row of teeth on a cone, in dependence on an expected trajectory of said tooth through formation material at the cutting face; b) calculating the width of uncut rings of formation material, in dependence on the orientation of said row of teeth, and adjusting the position of said row of teeth in dependence on said calculated width; and c) recalculating the rotational speed of said cone, if the position of said row is changed, and accordingly recalculating said trajectory of teeth in said row.

According to another disclosed class of innovative embodiments, there is provided: A method of designing a roller cone bit, comprising the steps of: calculating the respective trajectories, of at least two non-axisymmetric teeth in different rows of a roller cone bit, through formation material at the cutting face; and graphically displaying, to a design engineer, both said trajectories and also respective orientation vectors of said teeth, as the engineer adjusts design parameters.

According to another disclosed class of innovative embodiments, there is provided: A method of designing a roller cone bit, comprising the steps of: calculating the curved trajectory of a non-axisymmetric tooth through formation material at the cutting face, as the bit and cones rotate; calculating a straight line approximation to said curved trajectory; and orienting said tooth with respect to said approximation, and not with respect to said curved trajectory.

According to another disclosed class of innovative embodiments, there is provided: A roller cone drill bit designed by any of the methods described above, singly or in combination.

According to another disclosed class of innovative embodiments, there is provided: A rotary drilling system, comprising: a roller cone drill bit designed by any of the methods described above, singly or in combination, a drill string which is mechanically connected to said bit; and a rotary drive which rotates at least part of said drill string together with said bit.

According to another disclosed class of innovative embodiments, there is provided: A method for rotary drilling, comprising the actions of: applying weight-on-bit and rotary torque, through a drill string, to a drill bit designed in accordance with any of the methods described above, singly or in combination.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the various teachings can optionally be adapted to two-cone or four-one bits.

In the example of FIGS. 9A–9C the crest profiles of all rows except the gage rows are shown as identical (and their crest orientations are indicated by simple ellipses). However, this is not necessary: optionally the designer can be allowed to plug in different tooth profiles for different rows, and the optimization routines can easily substitute various tooth profiles as desired. In particular, various tooth shapes can be selected from a library of profiles, to fit the scraping motion of each row.

In one contemplated class of alternative embodiments, the orientations of teeth can be perturbed about the optimal value, to induce variation between the gage rows of different cones (or within an inner. row of a single cone), to provide some additional resistance to tracking.

Of course the bit will also. normally contain many other features besides those emphasized here, such as gage buttons, wear pads, lubrication reservoirs, etc. etc.

Additional general background, which helps to show the knowledge of those skilled in the art regarding implementations and the predictability of variations, may be found in the following publications, all of which are hereby incorporated by reference: *APPLIED DRILLING ENGINEERING*, Adam T. Bourgoyne Jr. et al., Society of Petroleum Engineers Textbook series (1991), *OIL AND GAS FIELD DEVELOPMENT TECHNIQUES: DRILLING*, J.-P. Nguyen (translation 1996, from French original 1993), MAKING HOLE (1983) and DRILLING MUD (1984), both part of the Rotary Drilling Series, edited by Charles Kirkley.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A method of designing a roller cone bit, comprising the steps of:

inputting initial bit geometry, rock properties, and bit operational parameters;

stepping through a sequence of time intervals and, at each of said time intervals, mapping the locations of teeth which are cutting at a given time, and calculating cutting area, volume and forces for each of said teeth which is cutting at said given time, using the results of said mapping step;

adjusting the orientation of said teeth, in accordance with the results of said calculating step.

2. The method of claim 1, wherein each of said teeth on said bit is non-axisymmetric.

3. A roller cone drill bit designed by the method of claim 1.

4. A rotary drilling system, comprising:

a roller cone drill bit designed by the method of claim 1;

a drill string which is mechanically connected to said bit from a surface location; and a rotary drive which rotates at least part of said drill string together with said bit.

5. A method for rotary drilling, comprising the actions of:

applying weight-on-bit and rotary torque, through, a drill string, to a drill bit designed in accordance with claim 1.

6. A method of designing a roller cone bit, comprising the steps of:

using respective coordinate systems for tooth, cone, bit and hole to define the location of a crest point of a tooth in three dimensional space;

using the locations of respective teeth on a bit to calculate pattern of drilling;

using said pattern of drilling to optimize the orientation of said teeth on said drill bit.

* * * * *